US005935745A

United States Patent [19]

Ohtsu et al.

[11] Patent Number: 5,935,745

[45] Date of Patent: Aug. 10, 1999

[54] IMAGE FORMING METHOD, IMAGE FORMING MEDIUM AND IMAGE RECEIVING MEDIUM

[75] Inventors: Shigemi Ohtsu; Satoshi Tatsuura; Makoto Furuki; Takao Tomono; Lyong Sun Pu, all of Ashigarakami-gun, Japan

[73] Assignee: Fuji Xerox Co., Ltd., Tokyo, Japan

[21] Appl. No.: 08/814,230

[22] Filed: Mar. 11, 1997

[30] Foreign Application Priority Data

Mar. 15, 1996 [JP] Japan ..... 8-059406

[51] Int. Cl.[6] ..... G03G 13/00

[52] U.S. Cl. ..... 430/31; 204/478

[58] Field of Search ..... 430/31, 48, 49; 204/478, 490

[56] References Cited

U.S. PATENT DOCUMENTS

| | | | |
|---|---|---|---|
| 4,172,180 | 10/1979 | Takeda et al. | 428/522 |
| 5,762,772 | 6/1998 | Tomono et al. | 204/418 |
| 5,821,018 | 10/1998 | Ohtsu et al. | 430/31 |

FOREIGN PATENT DOCUMENTS

A 2-142835 5/1990 Japan .

OTHER PUBLICATIONS

Yoshimura, Susumu. "Electroconductive Polymers." *Polymers Society of Japan.*

Yamashita, Kazuo and Hiroshi Kitani. "Functions and Designs of Electroconductive Organic Films." *Surface Science Society of Japan.*

Yoshino, Katsumi. "Fundamentals and Applications of Electroconductive Polymers." I.P.C., 1988.

Shinohara, Horoaki et al. "Ion–sieving Electrosynthesized Polypyrrole Films." *J. Chem. Soc., Chem. Commun.*, 1986, pp. 87–88.

Fujishima et al. "pH Control of an Aqueous Solution by Use of a Polypyrrole–Coated Electrode." *Journal of Chemical Society of Japan*, n3, pp. 451–456, 1986.

Shinohara et al. *Journal of Chemical Society of Japan*, n3, pp. 465–469, 1986.

Okano et al., "pH Control of an Aqueous Solution by Use of a Polypyrrole–Coated Electrode." *Journal of Chemical Society of Japan*, n3, pp. 451–456, 1986.

*Primary Examiner*—John Goodrow

*Attorney, Agent, or Firm*—Oliff & Berridge, PLC

[57] ABSTRACT

The present invention provides an image forming method which is featured by the advantages such as a high-quality image, a relatively high speed operation, a low running cost, energy saving, resource saving and friendliness to both environments and users.

First, there is prepared an image forming medium which comprises on an electroconductive substrate an electroconductive polymer layer capable of taking in and holding an ionic dye as a result of the change in at least two states selected from the group consisting of an oxidized state, a neutral state and a reduced state of the electroconductive polymer and which holds an ionic dye. Next, an image receiving medium, which has $OH^-$ ions having the same polarity as that of the ionic dye held in the electroconductive polymer layer, is brought into contact with the electroconductive polymer layer. Accordingly, there occurs an ion exchange between the ionic dye held in the electroconductive polymer layer and the $OH^-$ ions in the image receiving medium and the ion exchange produces an image pattern of the ionic dye on the image receiving medium.

14 Claims, 20 Drawing Sheets

POTENTIAL VERSUS SATURATED CALOMEL ELECTRODE

POTENTIAL VERSUS SATURATED CALOMEL ELECTRODE

BEFORE ION EXCHANGE

AFTER ION EXCHANGE

IMAGE FORMING METHOD, IMAGE FORMING MEDIUM AND IMAGE RECEIVING MEDIUM

BACKGROUND OF THE INVENTION

1. Field of the Invention

The present invention relates to an image forming method, image forming medium and image receiving medium utilizing an electroconductive polymer.

2. Description of the Related Art

Methods, which are currently utilized in a printer or the like for the purpose of transferring an image from an electric signal or optical signal to a recording medium such as paper, include, for example, dot-impacting, thermal transfer, thermal sublimation, ink jet and laser printing methods in electrophotography. These methods are roughly divided into three groups.

The methods, which are included in the first group, are those based on dot-impacting, thermal transfer and thermal sublimation. According to these methods, a sheet, which are in the form of an ink ribbon or a donor film and which contains a dispersed dye, is superposed on a paper or the like and the dye is transferred to the paper by the application of a mechanical impact or heat. Therefore, these methods always need expendable supplies and are associated with such disadvantages as high running costs due to difficulty in high-speed operation and poor energy efficiency. Further, the qualities of images are poor except for those obtained by the thermal sublimation method.

An ink jet method, which is included in the second group and is based on the mechanism that an ink is directly transferred to a paper from the head, is characterized by a low level of running costs, because no expendable supplies are necessary except for ink. However, the ink jet method is associated with a difficulty in high-speed operation, because it is difficult to electrically control all of the dots and to form the head corresponding to the width of the paper. Other disadvantages are that the minimal image unit is restricted by the size and interval of heads and that the printing speed decreases and the energy efficiency becomes poor with improving print quality.

An electrophotographic method such as a laser-printing method, which is included in the third group, is based on the mechanism that an image is formed via an intermediate transferring member. That is, according to an electrophotographic method, toner particles are caused to adhere to an electrostatic latent image created by laser spots and then the toner particles are transferred to a paper to form an image. This method is featured by a capability to form a relatively fine image and by a low level of running costs, because no expendable supplies are necessary except for toner. However, this method is associated with problems that a high voltage is necessary for forming an electrostatic latent image and for adhering/transferring toner particles. Further, a large amount of electricity is consumed and, therefore, ozone and nitrogen oxides are generated. Furthermore, all of the above-mentioned printing methods generate noisy sounds when the printers are operated.

On the other hand, other conventional image forming methods, such as an ordinary printing method and a silver salt photographic method, provide images with high quality.

The ordinary printing method, which involves the formation of a printing plate and provides low running costs in the case that a number of identical images are formed, is not suitable for general uses. In the case of a silver salt photographic method, media, which are not reusable, such as photographic films and papers, need to be employed so that the running costs are high and a high-speed operation of the method is impossible.

As stated in the above, none of aforementioned methods, in which an image from an electric signal or optical signal is transferred to a recording medium such as paper, can provide a desirous method featured by a high-quality image, a relatively high speed, a low level of running costs, energy saving, resource saving and advantage both to environment and to users.

A conceivable means to solve the above-mentioned problems is the utilization of an image forming medium which can form and transfer or directly form an image distribution created by image forming elements such as toner particles or ink corresponding to an object image in such a manner that the image distribution is in the same scale (the same width) as that of an image receiving medium (such as a paper) onto which the image is transferred. Although this medium also functions as a temporary carrying member of the image forming elements, the intake or release (delivery) of the image forming elements needs to be performed with relatively low energy and a continuous gradation. Another required function is that the unit of the image forming element be minimized.

An image forming medium, which is considered to have the above-mentioned functions, is an electroconductive polymer layer represented, for example, by polypyrrole, polythiophene and polyaniline. It has been known that the three states, i.e., oxidized state, neutral state and reduced state, of this type of polymer layer can be controlled chemically, electrically or electrochemically so that doping or dedoping of a counter ion takes place. The details of these characteristics are shown, for example, "Electroconductive Polymers" by S. Yoshimura (Polymers Society of Japan), "Functions and Designs of Electroconductive Organic Films" by K. Yamashita and H. Kitani (Surface Science Society of Japan) and "Fundamentals and Applications of Electroconductive Polymers" by K. Yoshino (I.P.C.). In short, if an ion itself, which is doped into and dedoped from an electroconductive polymer layer is a sort of image forming element, the ion is expected to exhibit its ability as a temporary carrying member of the image forming elements that fulfill the aforementioned requirements.

One of the problems, however, is that the counter ions which are doped into and dedoped from an electroconductive polymer are those which cannot be expected to become an image forming element, such as usual metals or anions and cations of electrolytes having a low molecular weight. Another problem is that, if an electroconductive polymer is synthesized in the presence of a high molecular weight anion, for example, such an anion cannot be dedoped from the polymer.

According to H. Shinohara et al., described in J. Chem. Soc., Chem, Commun, pp. 87 (1986), the size of an ion, which can be reversibly doped/dedoped, is determined by the microstructure of an electroconductive layer and is controllable, for example, by the size of a counter ion present at the time when the electroconductive polymer is polymerized from a monomer. This report, however, deals with ions having a molecular weight up to about 100 and discloses that the doping/dedoping characteristic becomes insufficient as the molecular weight increases. H. Shinohara et al. also report, in Journal of Chemical Society of Japan, No.3, pp.465 (1986), glutamic acid as a relatively large molecule that exhibits a reversible doping/dedoping characteristic, but this molecular weight is still below 150. Meanwhile, a dye generally used, which can be expected to be an image forming element, has a molecular weight mostly in the range of 500 to 1,500. Heretofore, a substance having this level of molecular weight has never been thought to be capable of being doped/dedoped reversibly.

It has been known that an ion having a small molecular weight, as mentioned above, is subjected to doping into and dedoping from an electroconductive polymer layer in order to utilize a color change accompanied by the doping and dedoping. However, this kind of technique has been centered on such applications as protective coatings for battery or solar cell and electrochromic displays. Therefore, none of these techniques has been used to replace a conventional image forming method.

One of a few examples of a known technique, whereby an electroconductive polymer itself is used as a material related to a marking application, is disclosed in Japanese Patent Application Laid-Open (JP-A) No. 2-142,835 titled "A method for controlling wettability of a thin film surface of a polymer and an image forming method and an image forming material utilizing said method". According this technique, a printing plate is prepared by electrically switching difference in the wettability between an oxidized state and a neutral state of the electroconductive polymer layer. Therefore, none of image forming elements (such as ink) is held within the electroconductive polymer layer by way of doping. Further, an adhered amount or transferred amount of a dye such as ink cannot be controlled by this technique.

Based on the above-described background, a new image forming method is needed which utilizes an electroconductive polymer as an image forming medium and which overcomes the problems associated with conventional image forming methods.

SUMMARY OF THE INVENTION

Accordingly, the first object of the present invention is to provide an image forming method which can form high-quality images at a relatively high speed, which has a low running cost, which can save energy and resource and which has advantages both to environment and to users.

The second object of the present invention is to provide an image forming medium suitable for the above-mentioned method.

The third object of the present invention is to provide an image receiving medium suitable for the above-mentioned method.

The present invention has been established as a result of studies conducted on the basis of the behavior of ionic dye moleculars in an electroconductive polymer layer. And, the first object of the present invention can be achieved by means of an image forming method utilizing an electroconductive polymer, which method comprises the steps of:

(1) preparing an image forming medium which comprises an electroconductive substrate and an electroconductive polymer layer thereon capable of taking in and holding ionic dyes as a result of the change in at least two states selected from the group consisting of an oxidized state, a neutral state and a reduced state of the electroconductive polymer and which holds the ionic dye, (2) bringing an image receiving medium, which has ions of the same polarity as that of the ionic dye held in the electroconductive polymer layer, into contact with the electroconductive polymer layer, and (3) forming an image pattern of the ionic dye on the image receiving medium by conducting ion exchanges between the ionic dye held in the electroconductive polymer layer and the ion in the image receiving medium.

According to the image forming method of the present invention, an image is recorded on the image receiving medium by transferring the ionic dye, which is held in the image forming medium in the step (1), to the image receiving medium as prepared in the step (2) by way of an ion exchange of step (3).

Besides, the scope of the step (3) include a spontaneous ion exchange by carrying out the step (2) and an accelerated ion exchange by applying any action or treatment (e.g., application of an electric current or irradiation with light).

The second object of the present invention can be achieved by means of an image forming medium which comprises an electroconductive substrate and an electroconductive polymer layer thereon capable of taking in and holding an ionic dye as a result of change in at least two states selected from the group consisting of an oxidized state, a neutral state and a reduced state of the electroconductive polymer and which is intended for use in the above-described image forming method. The third object of the present invention can be achieved by means of an image receiving medium which can contain an ion dissolved in an electrolyte solution and which is intended for use in the above-described image forming method. These media are suitable for the image forming method.

DESCRIPTION OF THE PREFERRED EMBODIMENTS

Figure 1:
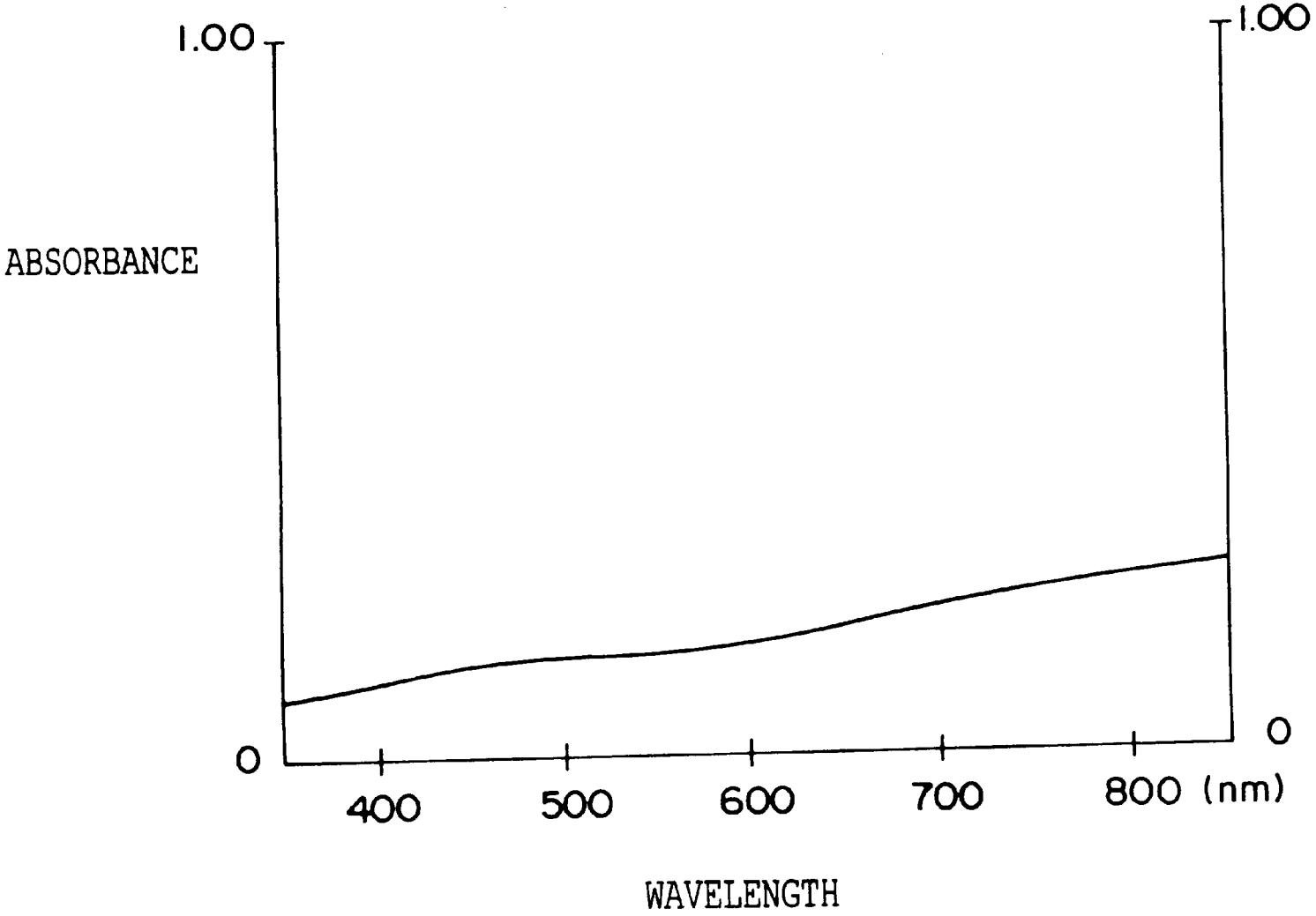
FIG. 1 shows absorption spectra of a polypyrrole film formed on ITO by carrying out polymerization in the presence of NaCl.

The present invention is explained in detail below.

According to the image forming method of the present invention, in the first essential step (1) there is prepared an image forming medium which comprises an electroconductive substrate and an electroconductive polymer layer thereon capable of taking in and holding an ionic dye as a result of the change in at least two states selected from the group consisting of an oxidized state, a neutral state and a reduced state of the electroconductive polymer and which holds the ionic dye.

The ionic dye is held in the image forming medium concurrently with the preparation of the image forming medium or after the preparation of the image forming medium.

The electroconductive polymer layer used in the image forming medium of the present invention can be of any type only if it can be electrochemically oxidized or reduced so that the doping of the ionic dye is possible. Examples of the electroconductive polymer layer include on a variety of one-dimensional electroconductive polymers such as polyacetylenes, polydiacetylenes, polyheptadienes, polypyrroles, polythiophenes, polyanilines, polyphenylene vinylenes, polythiophenylene vinylenes, polyisothianaphthenes, polysionaphthothiophenes, polyparaphenylenes, polyphenylene sulfides, polyphenylene oxides, polyfurans, polyphenanthrenes, polyselenophenes, polytellurophenes, polyazulenes, polyindenes, polyindoles, polyphthalocyanines, polyacenes, polyacenoacenes, polynaphthylenes, polyanthracenes, polyperinaphthalenes, polyperiphenylenes, polypyridinopyridines, polycyandienes, polyallenemetanoids and the like, or otherwise so-called ladder polymers or pyropolymers or two-dimensional electroconductive polymers such as graphite.

Besides, the electroconductive polymer layer used in the image forming medium of the present invention is preferably capable of being electrochemically oxidized or reduced so that not only doping but also dedoping (release of ion) can take place.

Almost all of ionic dye molecules can be used as the dye which can be taken into the image forming medium. Examples of the dye are a synthetic dye such as acridines, azaphthalides, azines, azuleniums, azos, azomethines, anilines, amidiniums, alizarins, anthraquinones, isoindolines, indigos, indigoids, indoanilines, indolyl phthalides, oxazines, carotenoids, xanthines, quinacridones, quinazolines, quinophthalones, quinolines, guanidines, chrome chelates, chlorophylls, ketone imines, diazos, cyanines, dioxazines, disazos, diphenylmethanes, diphenyl amines, squaliriums, spiropyrans, thiazines, thioindigos, thiopyriliums, thiofluorenes, triallyl methanes, trisazotriphenyl methanes, triphenyl methanes, triphenyl methane phthalides, naphthalocyanines, naphthoquinones, naphthols, nitrosos, bisazooxadiazoles, bisazos, bisazostilbenes, bisazohydroxyperinones, bisazofluorenones, bisphenols, bislactones, pyrazolones, phenoxazines, phenothiazines, phthalocyanines, fluoranes, fluorenes, flugids, perinones, perylenes, benzimidazolones, benzopyranes, polymethines, porphyllines, methines, mellocyanines, monoazos, leukoauramines, leukoxanthenes, rhodamines and the like, or otherwise natural dye such as turmeric, gardenia, red malt, scallion, grapevine, beet, beefsteakplant, berry, corn, cabbage, cacao and the like. A suitable dye needs to be selected in light of such factors as solubility of dye in accordance with conditions such as the properties of an electroconductive polymer layer to be used and a solvent to be used for the process.

An electroconductive polymer layer described above can be prepared by electrolytic polymerization. Generally, according to an electrolytic polymerization process, a monomer as a raw material used for preparing an electroconductive polymer layer, typically an aromatic compound having a low molecular weight, is electrochemically polymerized to form an electroconductive polymer layer on a substrate. Electrolytically reductive polymerization can be applicable to some halogenated aromatic compounds. The electroconductive polymer layer, thus produced by electrolytic polymerization, grows to take in a counter ion while maintaining an electrically neutral state during electrolytic polymerization. For example, if the potential of the electrode is made positive to carry out oxidative electrolytic polymerization to form an electroconductive polymer layer on the electroconductive substrate in which an anion in an oxidized state is being doped in the layer. This electroconductive polymer layer is made neutral if the potential is made negative and releases the anion, which has been taken in, to keep an electrical neutrality, and the dedoping is effected (this phenomenon is not essential to the present invention, but it is a preferred phenomenon). In the case of some electroconductive polymer layers exemplified by a polythiophene, if the potential is further made negative, a reduced state is attained and a cation is taken in the polymer layer to maintain an electrical neutrality. The dedoping of the cation which has been taken in is performed if a neutrality is regained by making the potential positive.

Typically, an electroconductive polymer layer, which is at least capable of being doped with an ionic dye molecule, can be produced by polymerizing a monomer which constitutes the electroconductive polymer in the presence of an ionic dye molecule or of a substance having a property and molecular weight equivalent to those of the ionic dye molecule. As a method for producing the electroconductive polymer layer, an electrolytic polymerization is most preferable. In the case where a monomer which constitutes the electroconductive polymer is polymerized in the presence of a substance, whose characteristics, such as ionic property (substituent), steric structure, molecular weight and the like, are close to those of an ionic dye molecule, a polymer film can be formed which is capable of being doped or dedoped with an ionic dye molecule.

In comparison with other electroconductive polymer layers, which are prepared in the presence of an ion having a smaller molecular weight, the electroconductive polymer obtained in the above-described manner can reversibly be doped or dedoped with a larger amount of an ionic dye molecule resulting from the electrochemical oxidation or reduction thereof. Therefore, the electroconductive polymer layer does not always require to be doped with an ionic dye molecule in the case where the thin film is prepared from the electroconductive polymer (powder or solution) except for the state where the thin layer is formed on an electroconductive substrate (electrode).

In addition to the above-described electrolytic polymerization based on electrochemistry, a variety of methods can be employed for the formation of an electroconductive polymer layer. These methods include chemical polymerization by use of an initiator such as a catalyst in a vapor phase, liquid phase or solid phase, followed by a process such as coating, or a modifying process such as pyrochemical process by use of a catalyst or sintering.

The electroconductive substrate, on which an electroconductive polymer layer is provided, functions as an electrode and is made from any material which is generally resistant to oxidation or reduction. Examples of the material are ITO, Au, Pt, Si, GaP, phthalocyanine, perylene and the like.

An image forming medium, which comprises a substrate and an electroconductive polymer layer thereon and which is capable of holding a dye molecule, is explained below by way of an example.

Figure 2:
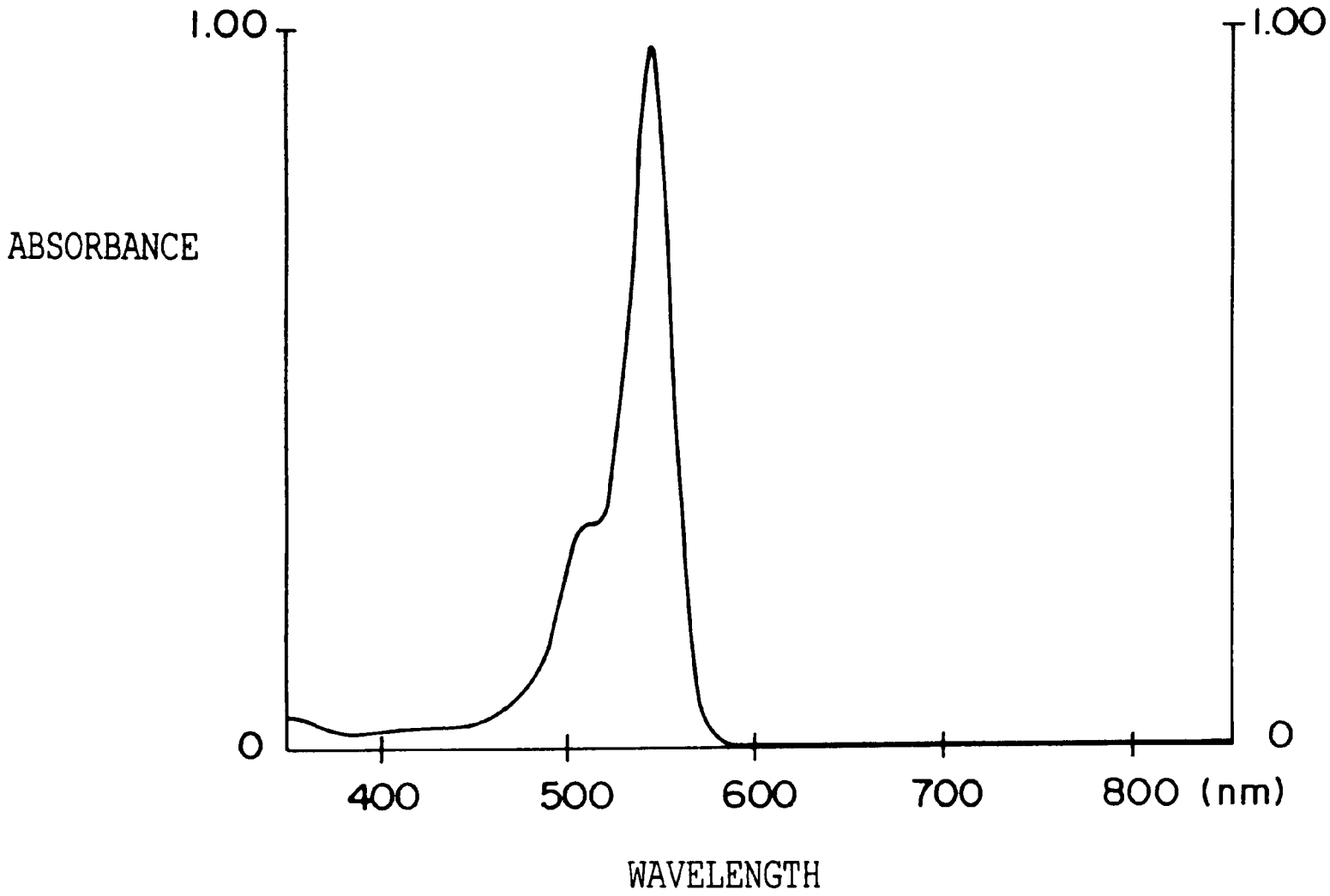
FIG. 2 shows absorption spectra of an aqueous solution of rose bengal.
Figure 3:
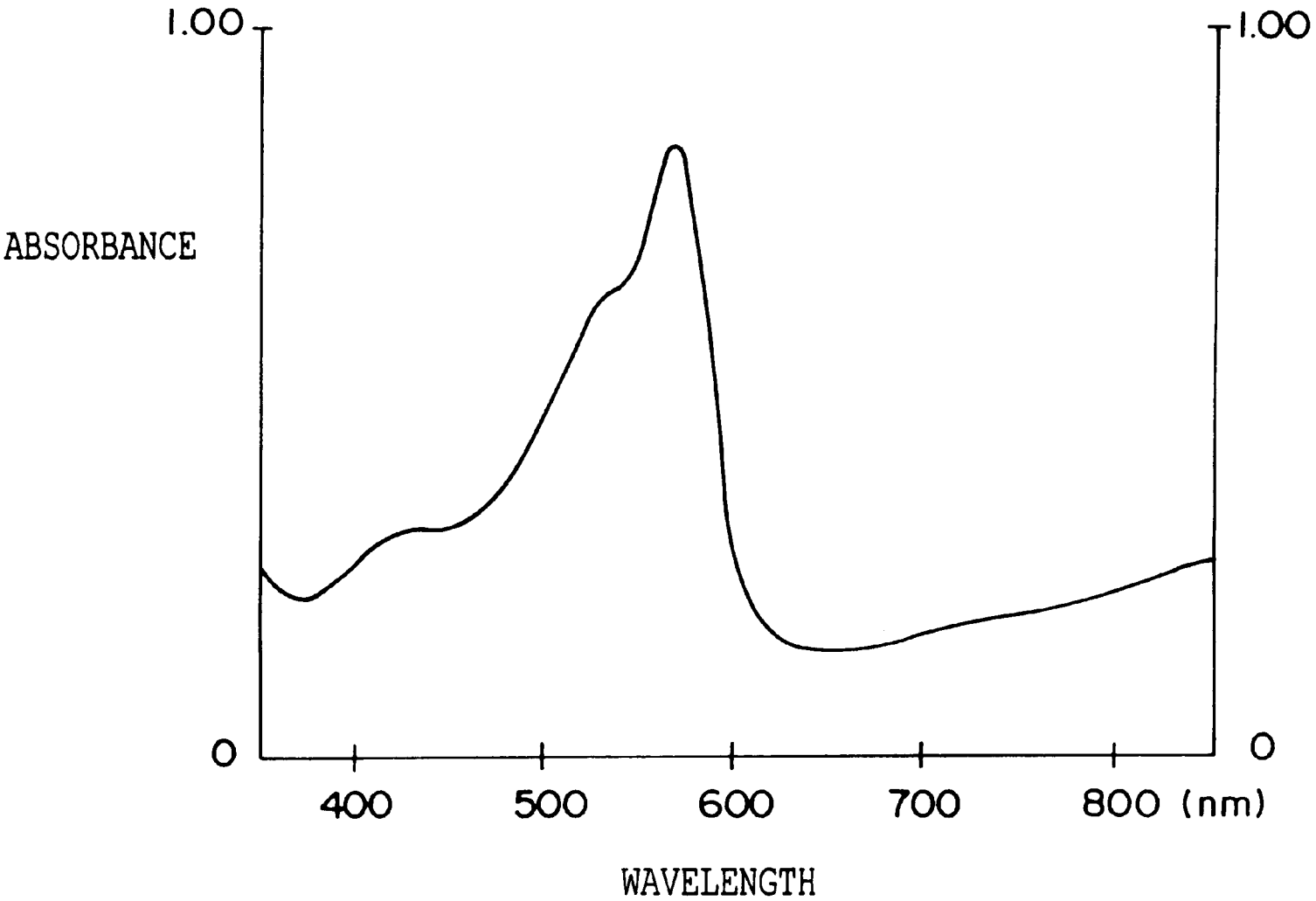
FIG. 3 shows absorption spectra of a polypyrrole film formed on ITO by carrying out polymerization in the presence of rose bengal.

FIG. 1 shows absorption spectra of an electroconductive polymer layer (a polypyrrole film) formed on ITO (indium tin oxide) by polymerization in the presence of NaCl. FIG. 2 shows absorption spectra of an aqueous solution of rose bengal. FIG. 3 shows absorption spectra of an electroconductive polymer layer (a polypyrrole film) formed on ITO by polymerization in the presence of rose bengal. FIG. 3 shows an absorption peak at 560 nm which is not observed in FIG. 1, thereby indicating that the rose bengal has been taken into the polypyrrole film.

Figure 4:
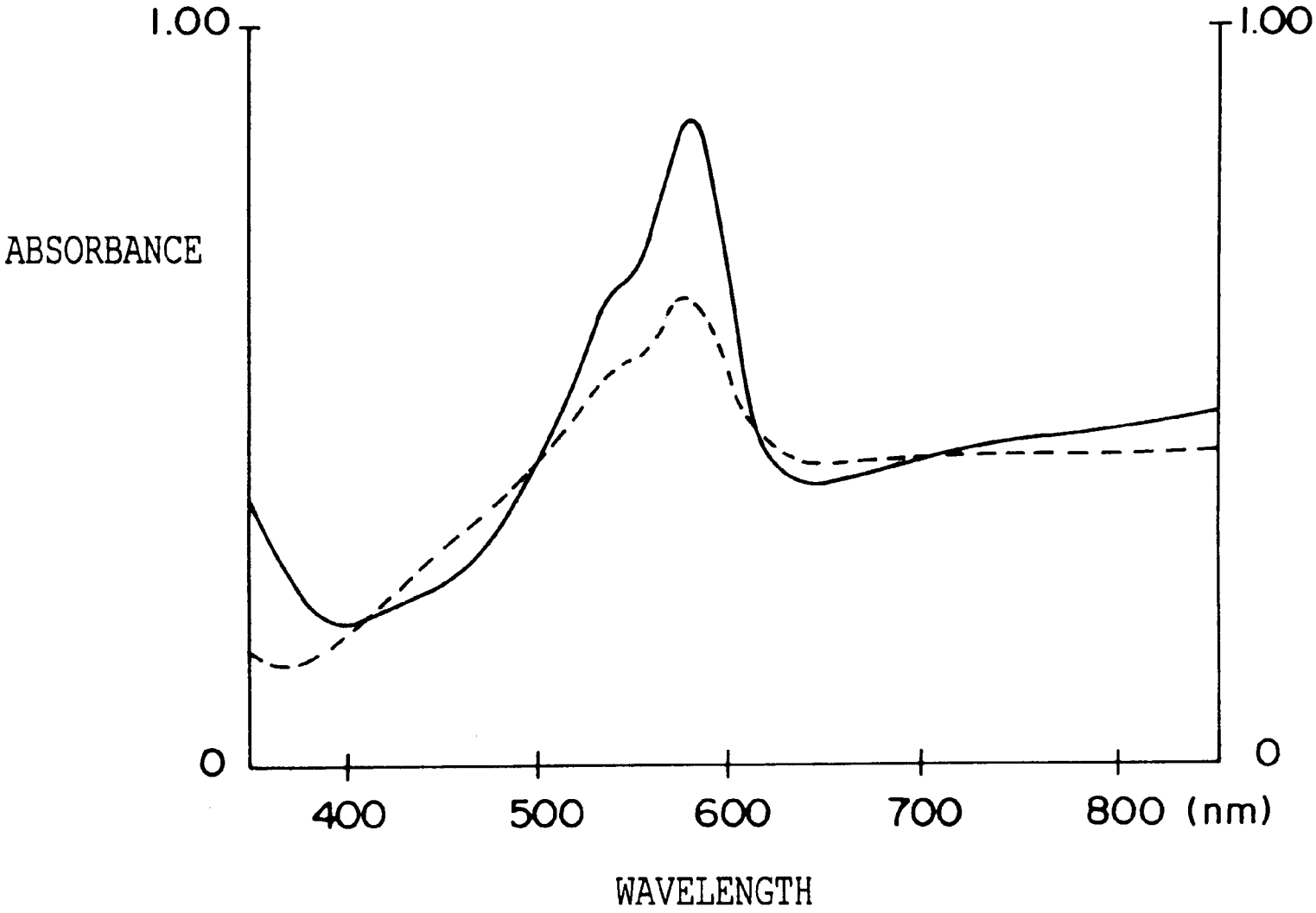
FIG. 4 shows graphs illustrating the doping of rose bengal into a polypyrrole film and the dedoping of rose bengal from the polypyrrole film formed by carrying out polymerization in the presence of rose bengal.

FIG. 4 shows absorption spectra (continuous line) of an electroconductive polymer layer (a polypyrrole film) formed on ITO by polymerization in the presence of rose bengal, and absorption spectra (broken line) after the application of a voltage of −1.0 V for 30 seconds to the thin film on ITO. Accordingly, the continuous line in FIG. 4 shows the state of the electroconductive polymer layer doped with the rose bengal, while the broken line illustrates the dedoping of the rose bengal from the electroconductive polymer layer. It is apparent from FIG. 4 that the dedoping level of the rose bengal is about 50 percent. However, when −1.0 V is applied to the film for 30 seconds on platinum, which is more stable and has a lower resistivity, almost all of the rose bengal is dedoped. According to a quantitative evaluation, 5 monomer units of the polypyrrole are doped with one molecule of the rose bengal.

Figure 5:
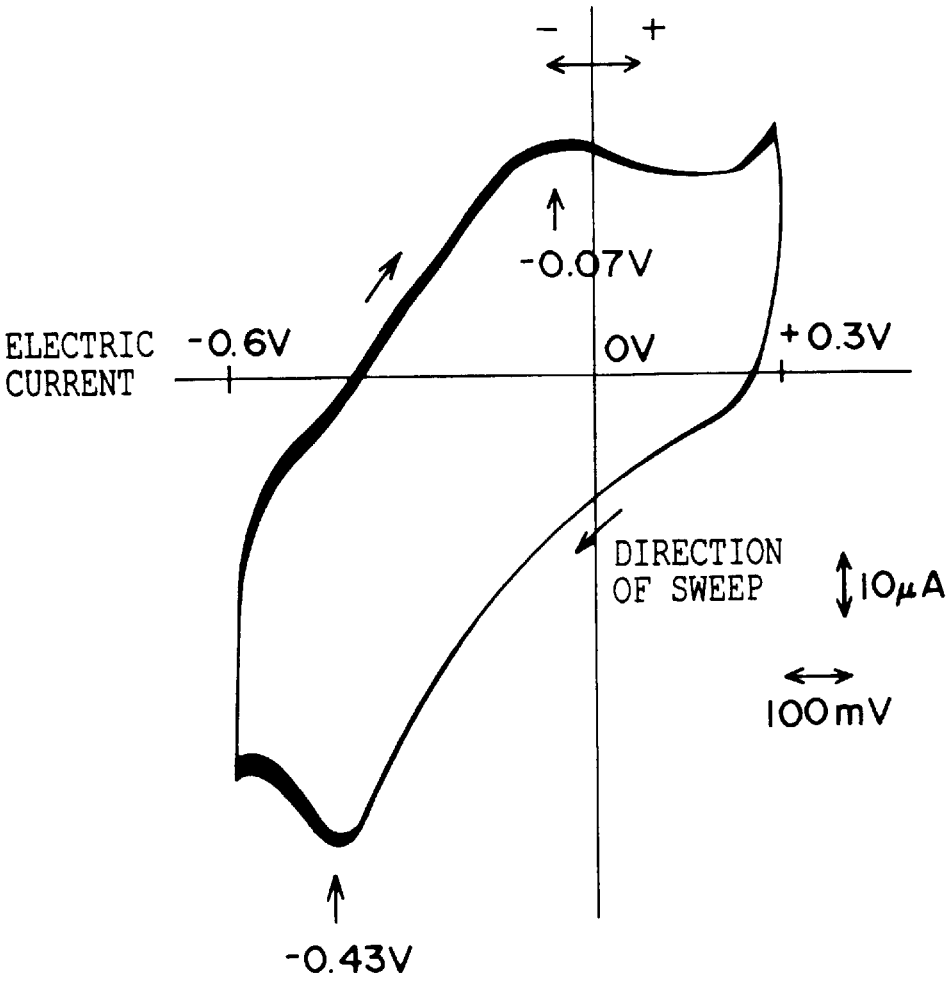
FIG. 5 shows a cyclic voltamgram of a polypyrrole film formed by carrying out polymerization in an aqueous solution of rose bengal.
Figure 6:
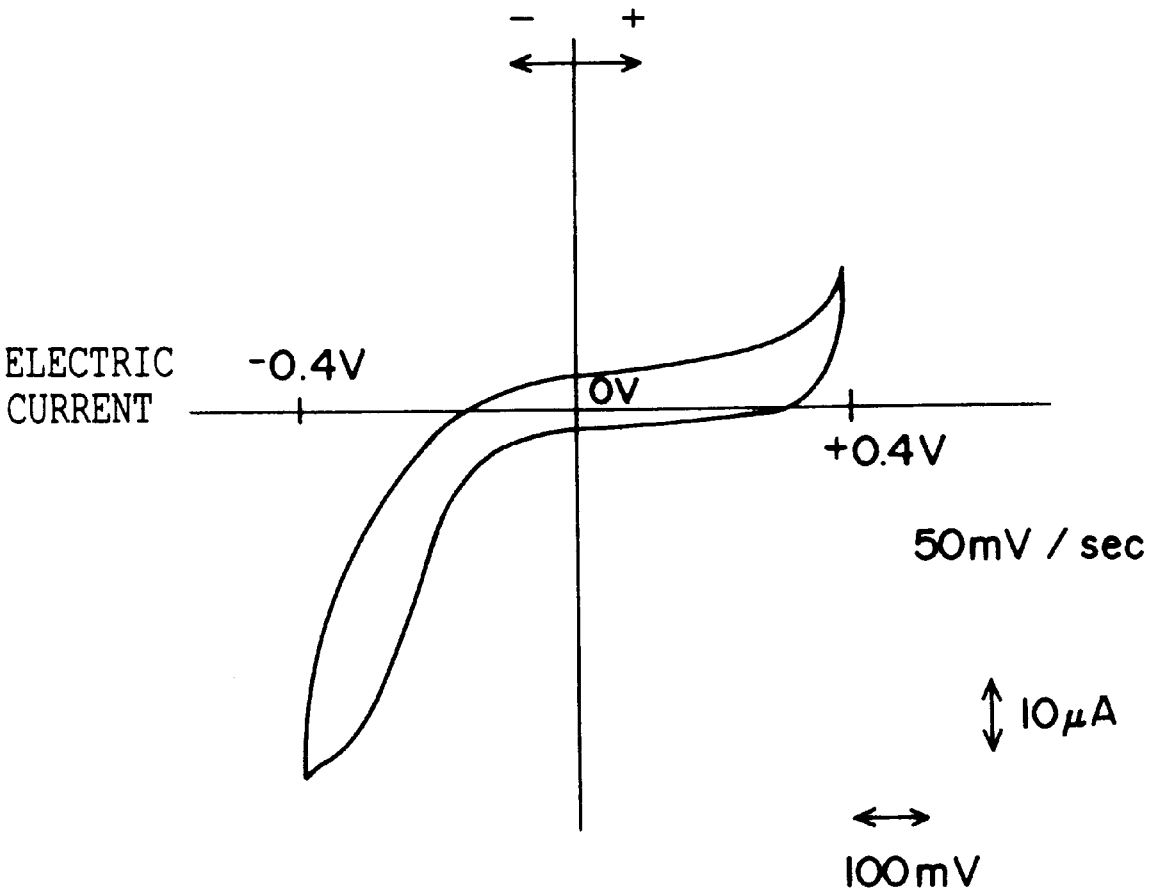
FIG. 6 shows a cyclic voltamgram of a polypyrrole film in an aqueous solution of rose bengal formed by carrying out polymerization in the presence of NaCl.

FIG. 5 shows a cyclic voltamgram in an aqueous solution of rose bengal, of an electroconductive polymer layer (a polypyrrole film) formed by polymerization in the presence of rose bengal. This curve was obtained by placing the polypyrrole film formed on platinum in an aqueous solution of rose bengal and applying sweeping potentials repeated between plus and minus versus a saturated calomel electrode (reference) to observe current. FIG. 6 shows a cyclic voltamgram in an aqueous solution of rose bengal, of an electroconductive polymer layer (a polypyrrole film) formed by polymerization in the presence of NaCl. Potentials were repeated by changed at the same sweep speed to observe flow of current.

According to FIG. 5, a peak current due to oxidation is observed at −0.07 V and a peak current due to reduction is observed at −0.43 V. FIG. 5 indicates that a film made by polymerization in the presence of rose bengal is reversibly oxidized and neutralized (reduced) in a solution of rose bengal and indicates the reversible doping/dedoping of rose bengal. FIG. 6 shows a cyclic voltamgram almost free of bulge, thereby indicating that the electroconductive polymer layer (a polypyrrole film) formed by polymerization in the presence of NaCl, cannot be sufficiently oxidized or reduced in the aqueous solution of rose bengal. That is, the capability of rose bengal to enter or leave the polymer matrix, i.e., doping or dedoping characteristic, is lower than that in the case shown in FIG. 5. Accordingly, the cyclic voltamgram highlights distinctive doping/dedoping behaviors of an anionic dye molecule into an electroconductive polymer layer.

Figure 7:
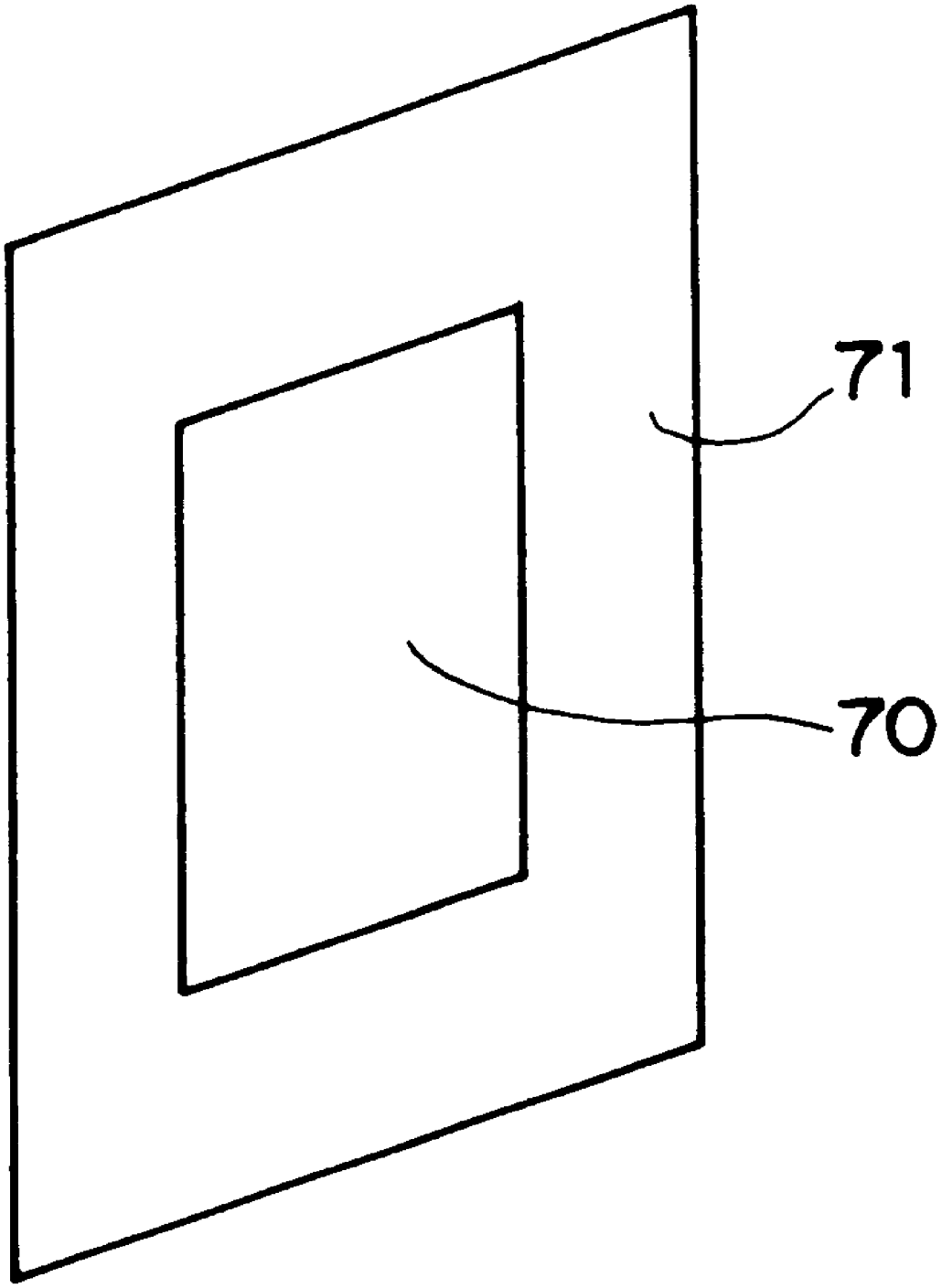
FIG. 7 is a diagram schematically illustrating one example of the essential step (2) of the image forming method of the present invention.

Next, the essential step (2) of the image forming process of the present invention is explained. As shown in FIG. 7, according to the step (2), an image receiving medium 71, which has an ion of the same polarity as that of the ionic dye held in the electroconductive polymer layer of the image forming medium 70, is brought into contact with the electroconductive polymer layer.

Examples of the image receiving medium are hydrophilic materials such as paper, fabric, non-woven fabric and the like.

The image receiving medium is coated or impregnated preferably with an electrolyte solution. This treatment promotes the ion exchange step (3).

The ions, which are held in the image receiving medium and have the same polarity as that of the ionic dye held in the electroconductive polymer layer, preferably have a higher affinity for the electroconductive polymer layer than for the image receiving medium. This is required to enable the ion exchange step (3) to be promoted spontaneously.

In the case where the electroconductive polymer layer holds anionic dyes, the ions in the image receiving medium are $OH^-$ and the pH value of the image receiving medium is preferably controlled to a value greater than 7. On the other hand, in the case where the electroconductive polymer layer holds cationic dyes, the ions in the image receiving medium are $H^+$ and the pH value of the image receiving medium is preferably controlled to a value equal to or under 7.

Next, the essential step (3) of the image forming process of the present invention is explained. According to the step (3), an image pattern of the ionic dye is formed on the image receiving medium by conducting ion exchanges between the ionic dye held in the electroconductive polymer layer and the ion in the image receiving medium.

Figure 8:
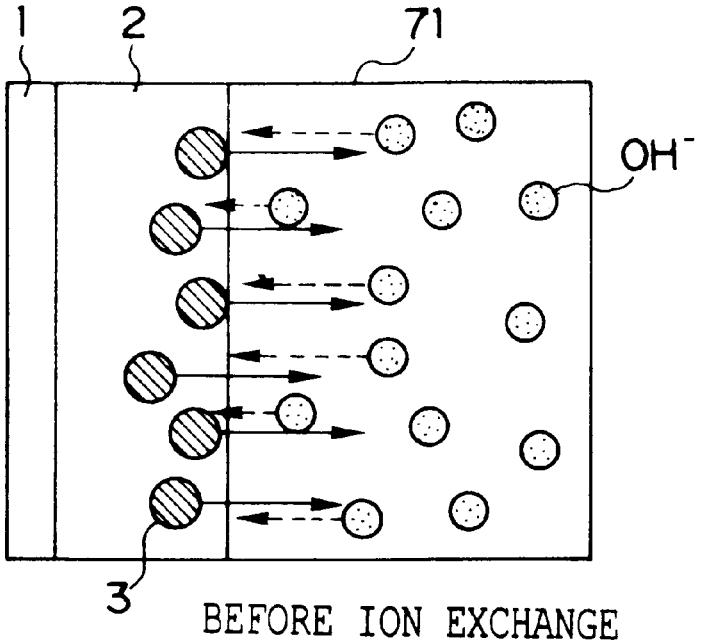
FIG. 8 is a schematically diagram illustrating one procedural example of the essential step (3) of the image forming method of the present invention.
Figure 9:
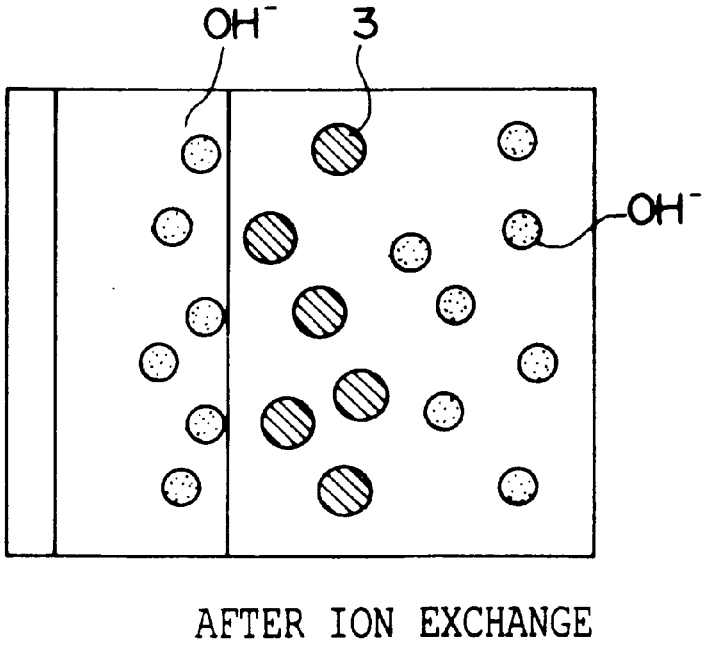
FIG. 9 is a schematically diagram illustrating the completion of the step of FIG. 8.
Figure 10:
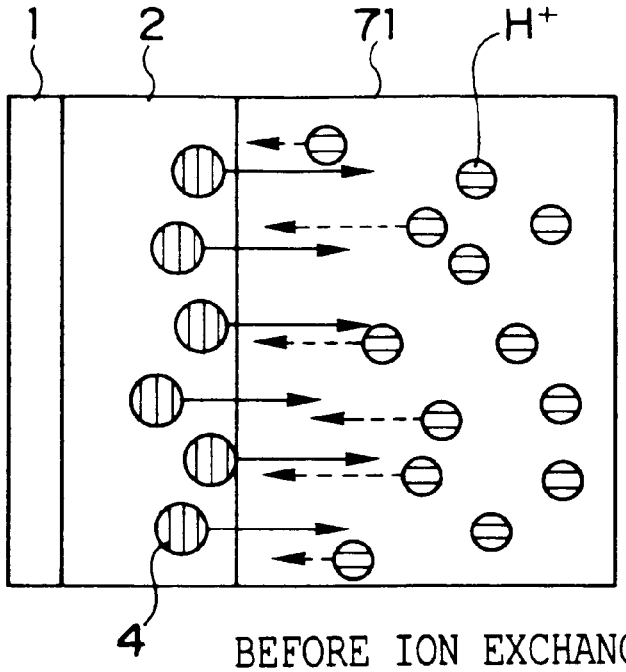
FIG. 10 is a schematically diagram illustrating another procedural example of the essential step (3) of the image forming method of the present invention.
Figure 11:
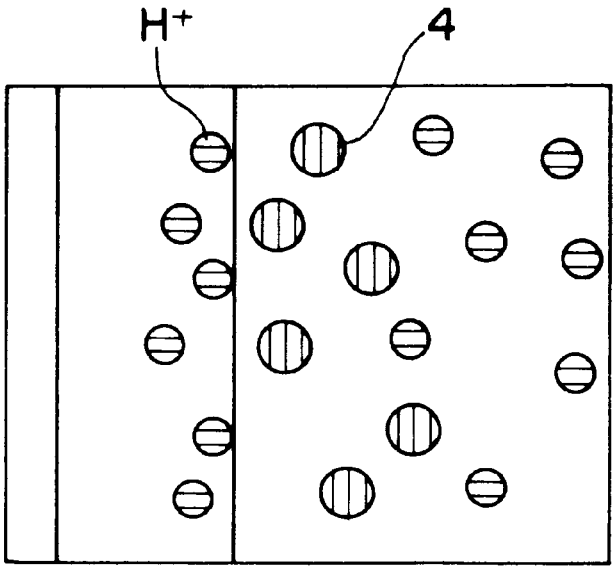
FIG. 11 is a schematically diagram illustrating the completion of the step of FIG. 10.

For example, as shown in FIG. 8, an image receiving medium 71, which has anionic ions of $OH^-$, is brought into contact with an electroconductive polymer layer 2 which is formed on an electroconductive substrate 1 and holds anionic dye molecules 3 so as to cause ion exchanges between the $OH^-$ ions and the anionic dye molecules 3, as illustrated in FIG. 9. On the other hand, as shown in FIG. 10, an image receiving medium 71, which has cationic ions of $H^+$, is brought into contact with an electroconductive polymer layer 2 which is formed on an electroconductive substrate 1 and holds cationic dye molecules 4 so as to cause ion exchanges between the $H^+$ ions and the cationic dye molecules 4, as illustrated in FIG. 11.

The ion exchange can be caused to proceed as smoothly as possible by a proper selection of the type of the image receiving medium 71 (e.g., kinds of the electrolyte solution to be incorporated or ions to be exchanged with the dye molecules) or pH value of the image receiving medium 71 depending on the kinds of the dye molecules 3 or 4 held in the electroconductive polymer layer. For example, in the case of a thin film of polypyrrole holding rose bengal dyes, the rose bengal dyes leave the polypyrrole film as a result of an ion exchange between the rose bengal ions and the $OH^-$ ions of an alkaline buffer solution, although nothing happens in the case that a neutral buffer solution (pH=7) or an acidic buffer solution (pH=4.5–7) is used.

As described above, it is preferred that ion exchange is caused spontaneously in order to form images simply. In the case that an electroconductive polymer layer which is capable of being ion-doped(ion holding) or dedoped (ion release) as a result of an electrochemical oxidation or reduction is used, a transfer operation by the application of an electric current, in addition to the transfer by way of ion exchange, will make it possible to carry out the transfer in an easier manner and with a higher speed.

Transfer due to the application of an electric current utilizes the doping states of an ion which are different from each other according to at least two states selected from an oxidized state, a neutral state and a reduced state of the electroconductive polymer layer. That is, by using anionic or cationic dye molecules as anions or cations to be doped or dedoped, the ionic dye molecules are held in the electroconductive polymer layer, released from the layer and transferred to the image receiving medium such as paper. The amount of the ion doped into the electroconductive polymer layer depends on the potential and the time period of the application of current, i.e., the charge amount.

Accordingly, if a control system is set up so that the doping of the dye starts at a threshold potential or above, the concentration of the dye molecule in the electroconductive polymer layer can be controlled in a continuous manner by controlling the amount of charge. Likewise, if a control system is set up so that the dedoping of the dye starts at a threshold potential or above, the concentration of the dye molecule to be released from the electroconductive polymer layer can be controlled in a continuous manner by controlling the amount of charge. Further, if a distribution of potential is provided to the electroconductive polymer layer or to the electroconductive substrate, an ionic dye can be taken into the electroconductive polymer layer or can be released from the electroconductive polymer layer selectively.

Figure 12:
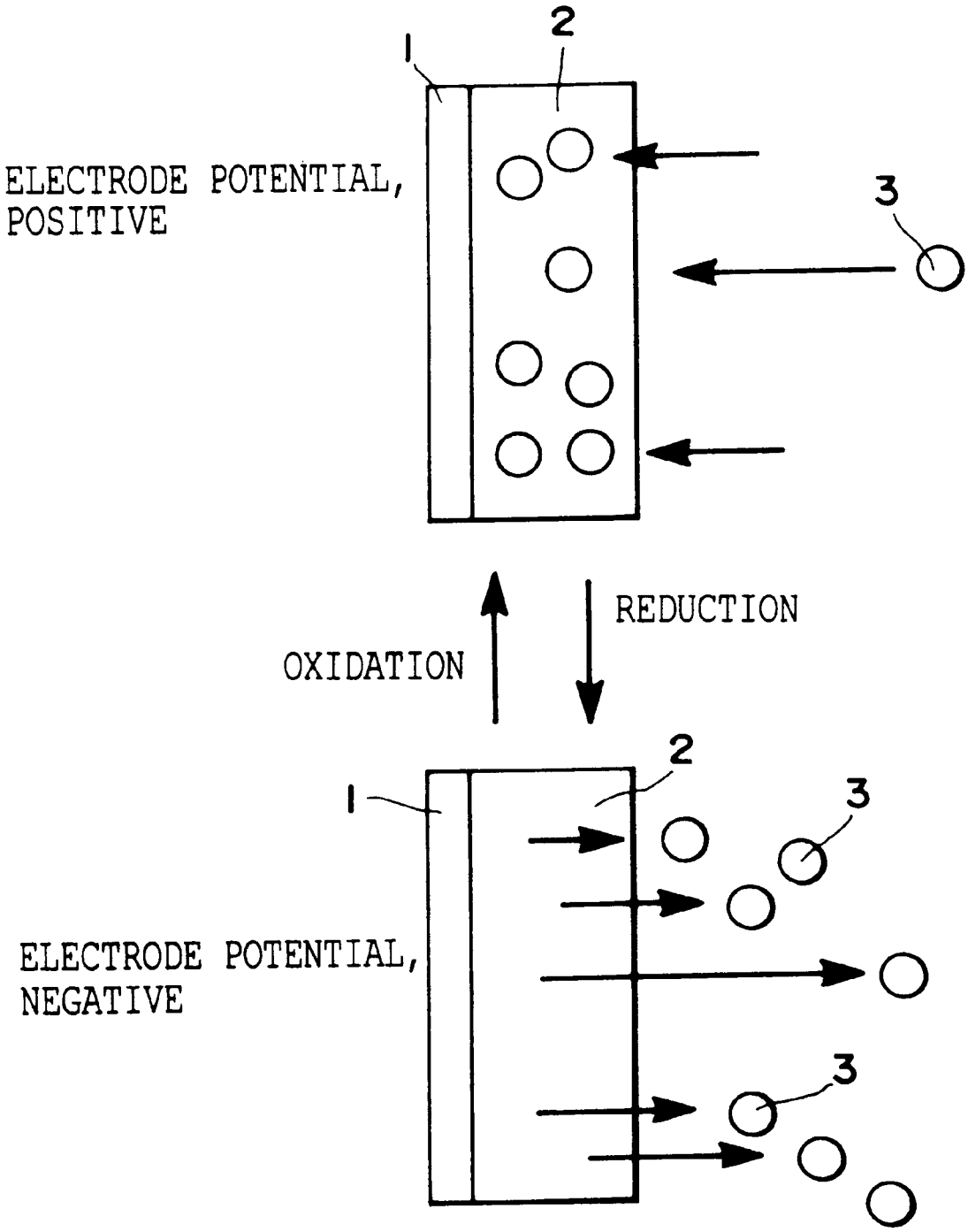
FIG. 12 is a schematically diagram illustrating the doping of an anionic dye by the oxidation of the electroconductive polymer layer and the dedoping of the anionic dye by the reduction of the electroconductive polymer layer as a result of the application of an electric current.
Figure 13:
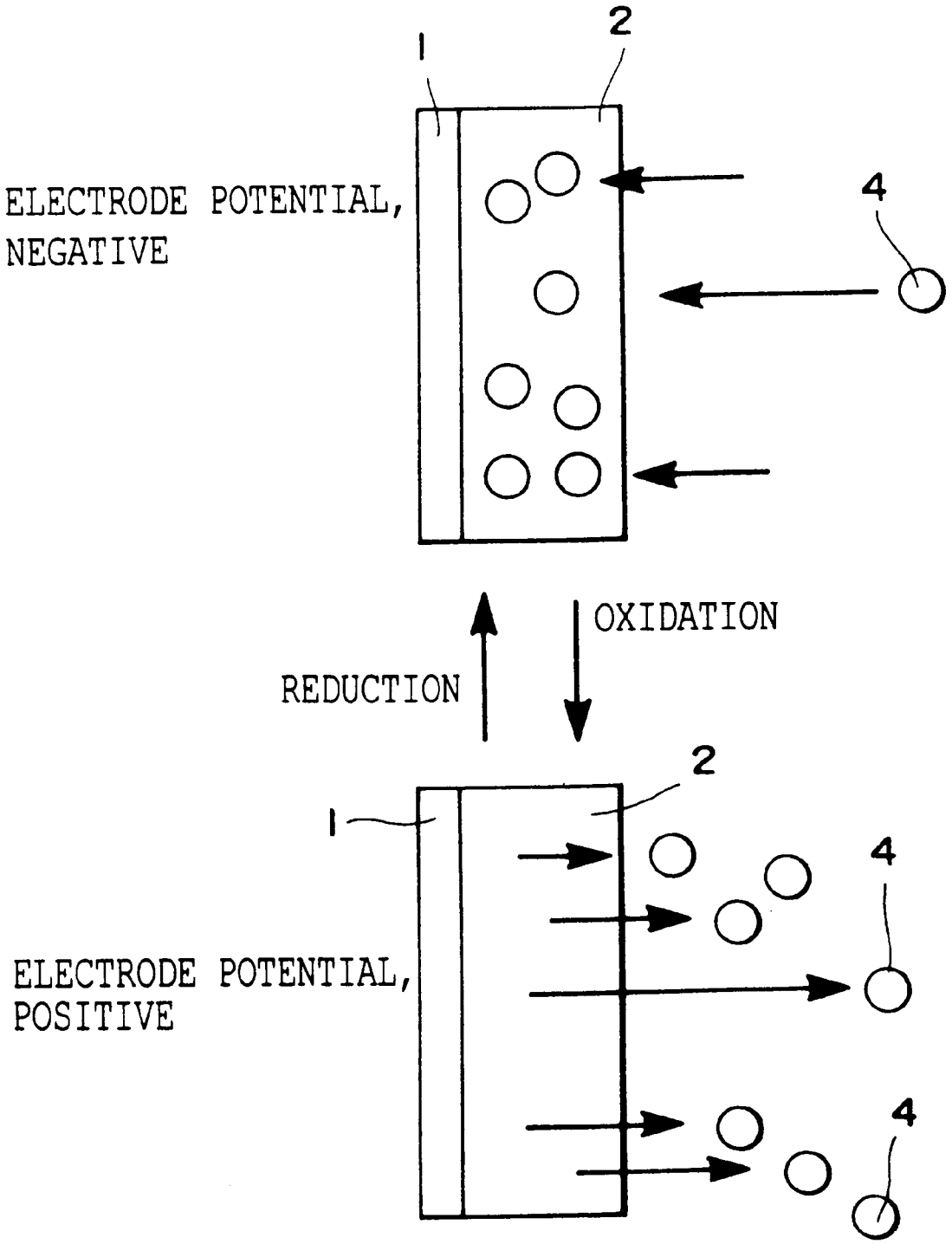
FIG. 13 is a schematically diagram illustrating the doping of a cationic dye by the reduction of the electroconductive polymer layer and the dedoping of the cationic dye by the oxidation of the electroconductive polymer layer as a result of the application of an electric current.

The principle of doping and dedoping of an ionic dye molecule in an electroconductive polymer layer is illustrated in FIG. 12 for an anionic dye molecule and in FIG. 13 for a cationic dye molecule. In FIG. 12, 1 is an electroconductive substrate (electrode), 2 is an electroconductive polymer layer (polymer having a π-conjugated bond) and 3 is an anionic dye molecule. For example, if the electrode potential is made positive and the electroconductive polymer layer 2 is made by electrolytic polymerization, the electroconductive polymer layer 2 is formed on the electroconductive substrate 1 in an oxidized state and is doped with the anionic dye molecules 3. If a negative potential is applied, the electroconductive polymer 2 becomes electrically neutralized and release the anionic dye molecules 3, which have been taken in to keep the electrical neutrality. Conversely, if the potential of the electrode is made positive, the electroconductive polymer layer 2 is oxidized and takes in the anionic dye molecules 3 to keep an electrical neutrality.

In FIG. 13, 1 is an electroconductive substrate (electrode), 2 is an electroconductive polymer layer (polymer having a π-conjugated bond) and 4 is a cationic dye molecule. For example, if polythiophene is used as the electroconductive polymer layer 2, when the electrode potential is made to be negative, the electroconductive polymer layer 2 is reduced and is doped with the cationic dye molecules 4 to keep an electrical neutrality. If the potential of the electrode is made positive, the electroconductive polymer layer 2 is electrically neutralized and releases the cationic dye molecules 4 by way of dedoping.

The doping amount of the ionic dye molecule can be controlled by the concentration of the ionic dye molecule in the electrolyte solution, the potentials of the electroconductive substrate and of the electroconductive polymer layer and the time period of voltage application, and thus the doping amount is basically proportional to the charge amount flowing during the doping. Therefore, an electroconductive polymer layer containing a high concentration of the dye molecule ion can be obtained from an oxidation or reduction of an electroconductive polymer layer in an electrolyte solution containing the dye molecule by controlling the potential of the electroconductive substrate. Further, an image depicted in the concentration of the ionic dye molecule, which matches any image, can be formed as a distribution of a doping concentration in the electroconductive polymer layer by partially controlling the potential of the electroconductive substrate or the oxidized or reduced state of the electroconductive polymer layer.

Meanwhile, an electroconductive polymer layer, which has taken in the dye molecule ions, releases the dye molecule ions when a voltage, whose polarity is reverse to that of the voltage applied for the intake of the dye molecule ions, is applied to the electroconductive polymer layer. In this case, the amount of the released dye molecule ions can be controlled by controlling the potential of the electrode, an electrical load of an object to which the release is directed and the release time.

Figure 14:
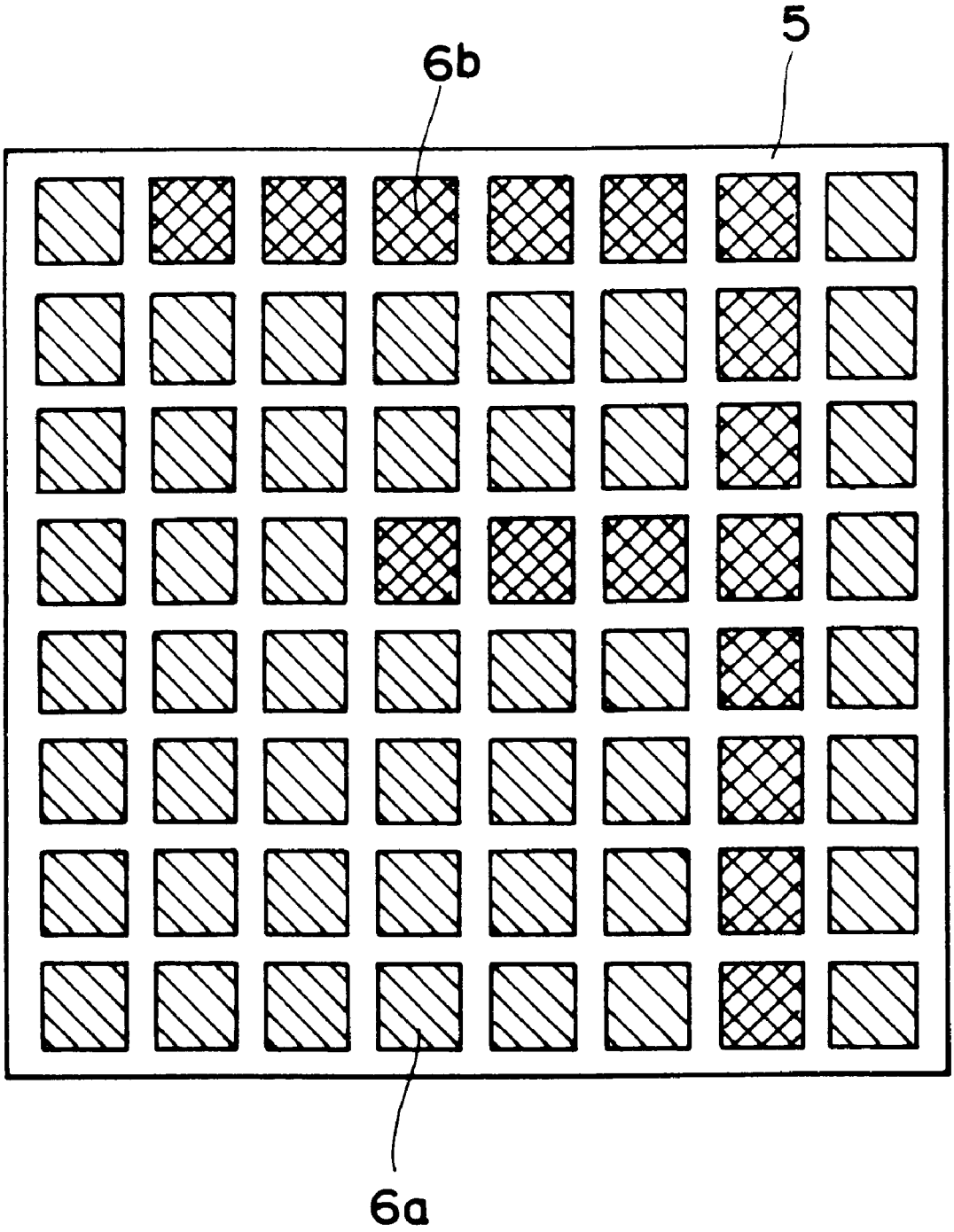
FIG. 14 is a schematically diagram illustrating an example of image formation by means of a polypyrrole film for marking formed on a matrix electrode.

Further, an image depicted in the concentration of the ionic dye molecule, which matches any image and which has been released from an electroconductive polymer layer, can be formed on the face of an image receiving medium by creating a partial distribution of the oxidized or reduced state in the electroconductive polymer layer. FIGS. 14–17 illustrate the process for forming images by utilizing the electroconductive polymer layer. FIG. 14 illustrates a matrix electroconductive substrate on which an electroconductive polymer layer is formed. On a matrix electroconductive substrate 5, electrodes are formed in a matrix pattern and the potential having any value can be applied to each electrode independently. Among the independent electrodes, on the matrix electroconductive substrate 5 there are, for example, an electrode region 6*a*, where the applied voltage can dedope rose bengal, and an electrode region 6*b* where rose bengal is in a doped state. That is, the electrode region 6*b*, where rose bengal is in a doped state, occupies the entire surface of the matrix electroconductive substrate 5, whereas the electrode region 6*a*, where the applied voltage can dedope rose bengal, occupies the region conforming to a target image. In FIG. 14, the electrode region 6*a*, where the applied voltage can dedope rose bengal, is indicated by a letter region conforming to an inverted F letter.

Figure 15:
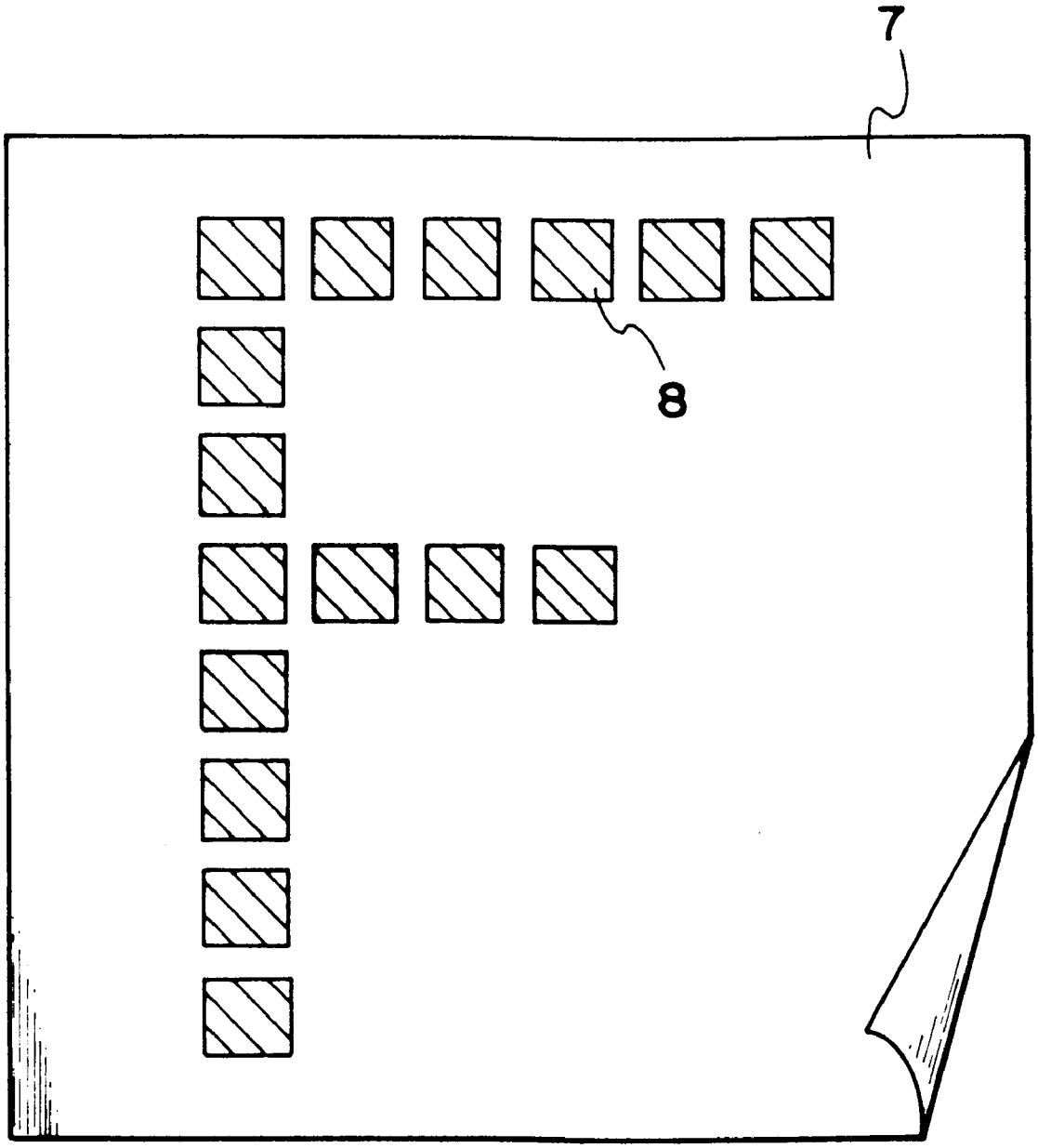
FIG. 15 is a schematically diagram illustrating the image made by the transfer of the image of FIG. 14.

Then, an image receiving medium 7, such as a transfer paper, is brought into contact with the matrix electroconductive substrate 5 and a predetermined voltage is applied to the electrode region 6*a*. As a result, as illustrated in FIG. 15, an image (F letter) which consists of a region 8 of the transferred rose bengal conforming to the configuration of the electrode region 6*a*, is formed on an image receiving medium 7.

Figure 16:
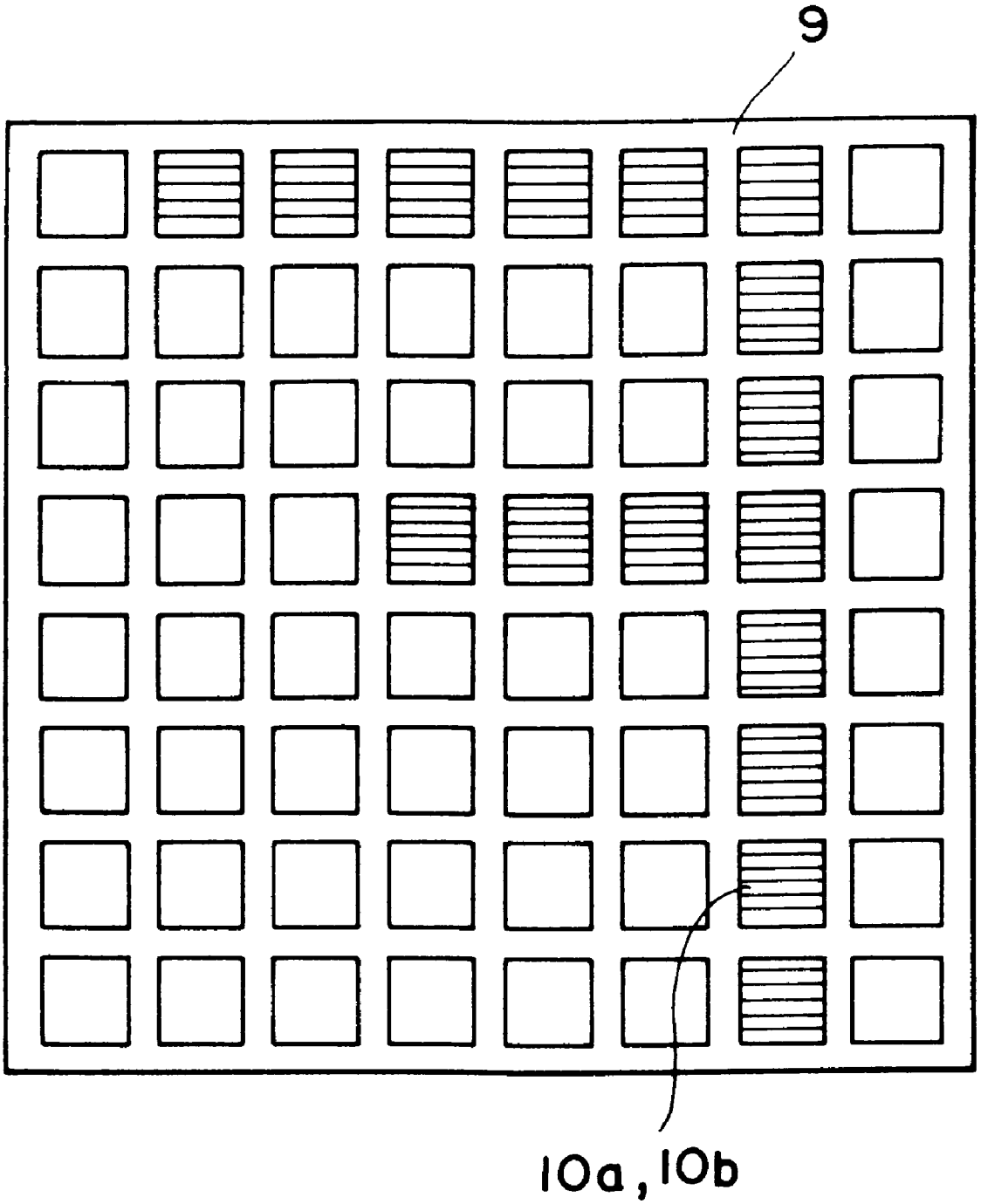
FIG. 16 is a schematically diagram illustrating another example of image formation by means of a polypyrrole film for marking formed on a matrix electrode.

FIG. 16 illustrates a matrix electroconductive substrate on which an electroconductive polymer layer is formed. On a matrix electroconductive substrate 9, electrodes are formed in a matrix pattern and the potential having any value can be applied to each electrode independently. Among the independent electrodes on the matrix electroconductive substrate 9 there are, for example, an electrode region 10*a*, where the applied voltage can dedope rose bengal, and an electrode region 10*b* where rose bengal is in a doped state. That is, the electrode region 10*a*, where the applied voltage can dedope rose bengal, is the electrode region 10*b* where the rose bengal is in a doped state. In FIG. 16, the electrode regions 10*a* and 10*b* indicate an inverted F letter.

Figure 17:
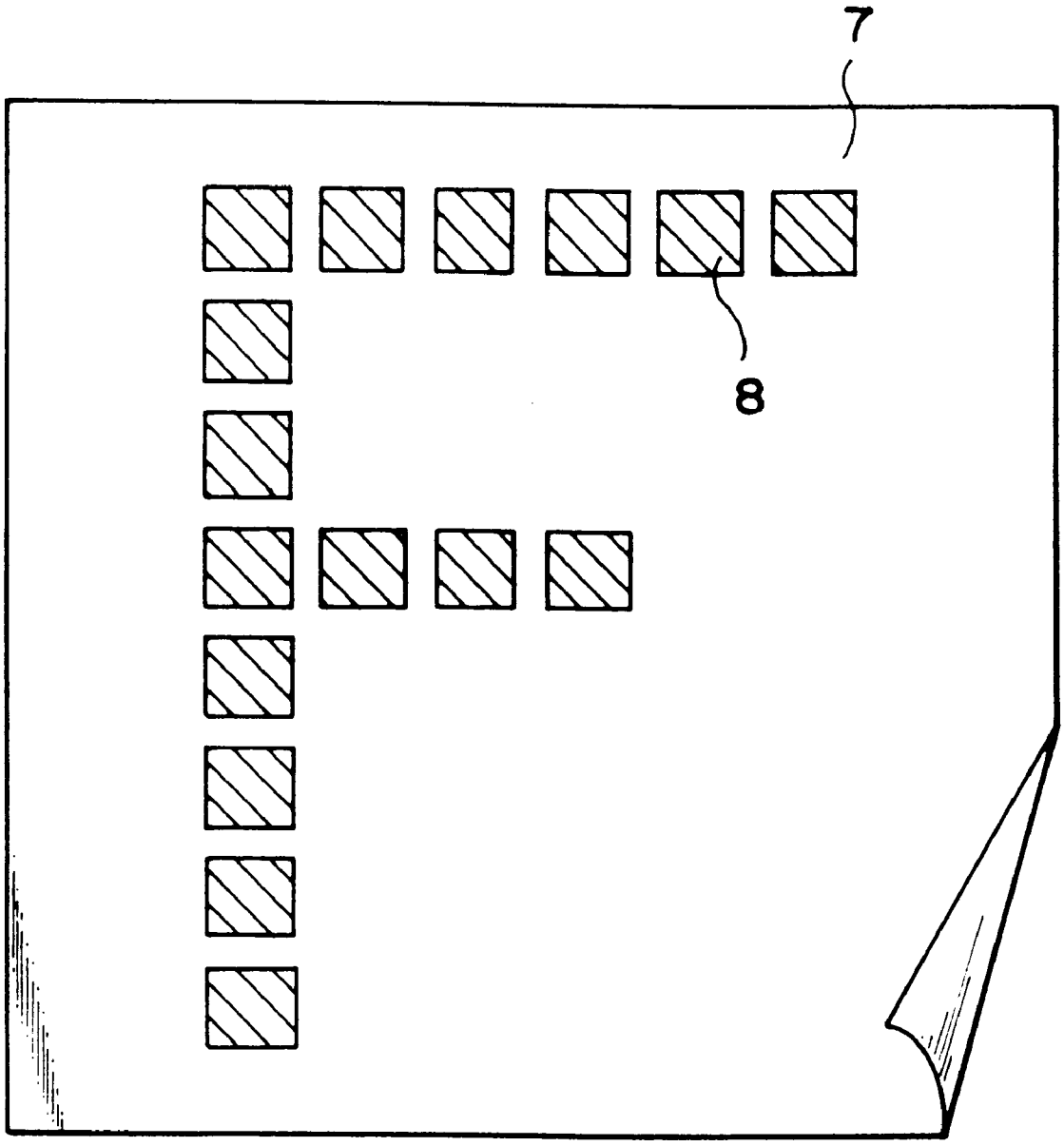
FIG. 17 is a schematically diagram illustrating the image made by the transfer of the image of FIG. 16.

Then, an image receiving medium 7, such as a transfer paper, is brought into contact with the matrix electroconductive substrate 9 and a predetermined voltage, which is capable of dedoping, is applied to the electrode region 10*a*. As a result, as illustrated in FIG. 17, an image (F letter) which consists of a region 8 of the transferred rose bengal conforming to the configuration of the electrode region 10*a*, is formed on an image receiving medium 7.

As explained in the above, three methods are applicable to the image formation, namely, providing a distribution of doping concentration at the time of doping, providing a distribution of release concentration at the time of release, and the utilization of both of the foregoing methods.

Figure 18:
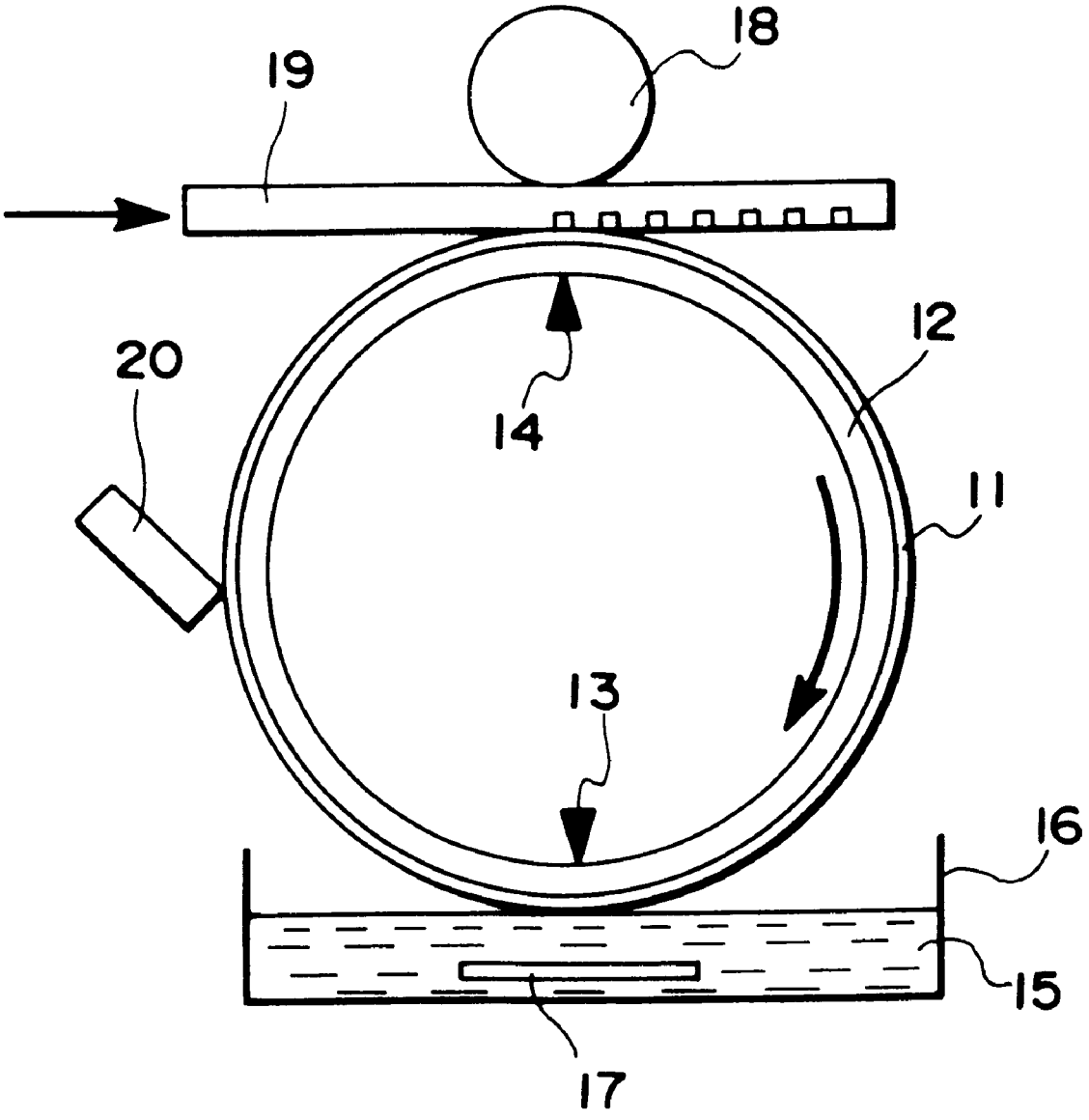
FIG. 18 is a schematically diagram illustrating one embodiment of an image forming apparatus applicable to the method of the present invention.

FIG. 18 illustrates an example of an image forming apparatus suitable for a continuous image transfer. In FIG. 18, in the inside of a matrix electroconductive cylinder 12 on the surface of which an electroconductive polymer layer 11 is formed, there are provided an intake potential driving electrode 13, which is utilized for the intake of an ionic dye molecule into the electroconductive polymer layer, and a transfer potential driving electrode 14, which is utilized for the release of an ionic dye molecule taken into the electroconductive polymer layer. Beneath the matrix electroconductive cylinder 12, there is a tank 16 which stores an electrolyte solution of dye 15 containing a dissolved ionic dye molecule. An opposed intake electrode 17 is positioned in the tank 16 so that the counter electrode 17 faces the intake potential driving electrode 13. An opposed transfer electrode 18 is positioned so that it keeps a predetermined gap from the surface of the matrix electroconductive cylinder 12. And, a transfer paper 19 can pass between the matrix electroconductive cylinder 12 and the opposed transfer electrode 18. In addition, a cleaning blade 20 is positioned so that it is in contact with the matrix electroconductive cylinder 12.

According to this image forming apparatus, a sufficient voltage is applied between the intake potential driving electrode 13 and the opposed intake electrode 17 so that the ionic dye molecule in the electrolyte solution of dye 15 is taken into the electroconductive polymer layer 11 in the predetermined region on the matrix electroconductive cylinder 12. Then, the surplus liquid on the matrix electroconductive cylinder 12 is eliminated by the cleaning blade 20. As the matrix electroconductive cylinder 12 rotates, a sufficient voltage is applied between the transfer potential driving electrode 14 and the opposed transfer electrode 18. As a result, the ionic dye molecule is transferred to the predetermined region of the transfer paper 19, thereby forming an image.

According to the above-described image forming apparatus, a desired image can be formed by doping the electroconductive polymer layer 11 with an ionic dye molecule and dedoping the ionic dye molecule from the electroconductive polymer layer 11 utilizing any of the electrodes positioned in the matrix electroconductive cylinder 12. Further, it is possible to form the image continuously if the electrolyte solution of dye molecule is supplied to the tank 16.

Transfer utilizing a combination of ion exchange and the application of an electric current can be carried out by bringing an image receiving medium 71 into contact with an image forming medium 70 and applying a voltage to the electroconductive substrate (functioning as an electrode) of the image forming medium 70 and the opposed substrate 72.

An image forming method utilizing a transfer due to ion exchange can use methods illustrated in FIGS. 14–16 or a method and apparatus (the transfer potential driving electrode 14 may be absent) illustrated in FIG. 18.

An additional preferred embodiment of the present invention is explained below.

In the case that an image is formed by using a transfer (release of a dye, this dedoping of the dye) due to the application of an electric current preferably an image receiving medium is coated or impregnated with an electrolyte solution so that an electric current flows through the medium easily. Generally, the electrochemical properties of a dye molecule or electroconductive polymer layer significantly vary depending on the hydrogen ion concentration in the aqueous solution. For example, a dye having a carboxyl group such as rose bengal, is known to fade at a hydrogen ion concentration of pH=4.5 or below. In addition, it has been known that, when an electrochemical reaction takes place, the hydrogen ion concentration of the solution varies locally in the neighborhood of an electrode (Okano et al., "pH Control of an Aqueous Solution by Use of a Polypyrrole-Coated Electrode" Journal of Chemical Society of Japan, No.3, pp.451–456 (1986)). These mean that, depending on the voltage value applied at the time of dedoping of a dye, the pH of a solution of a dye such as rose bengal becomes acidic, which causes the transferred image on a image receiving medium such as paper to fade. Therefore, a preferred embodiment of the present invention uses an image receiving medium which can maintain a pH value of at least the surface thereof, which is in contact with an electroconductive polymer layer, and a vicinity of the surface substantially constant. In this case, "substantially maintain" means maintaining a pH value within a range which can limit the defects, such as fading, to a desired level.

When an image receiving medium contains an electrolyte solution as described above, the electrolyte contained in the medium should be able to substantially maintain a pH value thereof even if an voltage is applied to the electrolyte. An example of such medium is a paper impregnated with a neutral buffer solution. A buffer whose pH is not neutral may be used in so far as the buffer does not change the properties of a dye to be used. By this technique, it is possible to inhibit the change in pH due to the electric field and to stabilize the dye transferred to an image receiving medium.

A suitable pH range of a buffer solution may be selected depending on a dye to be used. Generally, a buffer solution contains a combination of a salt and an acid, a combination of a salt and an alkali or a combination of a salt and a salt, and, therefore, a variety of combinations of substances can be selected. Typical examples of an acidic buffer solution are an oxalate standard solution, a tartrate standard solution, a phthalate standard solution, a hydrochloric acid/potassium chloride buffer solution, a potassium hydrogen phthalate/hydrochloric acid buffer solution, a potassium hydrogen phthalate/sodium hydroxide buffer solution, a glycine/sodium chloride/hydrochloric acid buffer solution, a sodium citrate/hydrochloric acid buffer solution, a sodium citrate/sodium hydroxide buffer solution, a potassium citrate/citric acid buffer solution, a potassium dihydrogen citrate/hydrochloric acid buffer solution, a potassium dihydrogen citrate/sodium hydroxide buffer solution, a succinic acid/sodium tetraborate buffer solution, a potassium dihydrogen citrate/sodium tetraborate buffer solution, a tartaric acid/sodium tartrate buffer solution, a lactic acid/sodium lactate buffer solution, an acetic acid/sodium acetate buffer solution and the like. Examples of a neutral buffer solution are a phosphoric acid standard solution, a potassium dihydrogen phosphate/sodiun hydroxide buffer solution, a potassium dihyrogen phosphate/sodium dihydrogen phosphate buffer solution, a potassium dihydrogen phosphate/sodium tetraborate buffer solution, a sodium diethylbarbiturate/sodium acetate/hydrochloric acid buffer solution, a 2,4,6-trimethylpyridine/hydrochloric acid buffer solution, a HEPES buffer solution and the like. Examples of an alkaline buffer solution are a borate buffer solution, a carbonate buffer solution, a boric acid/potassium chloride/sodium hydroxide buffer solution, a glycine/sodium chloride/sodium hydroxide buffer solution, a sodium tetraborate/hydrochloric acid buffer solution, a sodium tetraborate/sodium hydroxide buffer solution, a sodium tetraborate/sodium carbonate buffer solution, a hydrochloric acid/sodim carbonate buffer solution, a disodium hydrogen phosphate/sodium hydroxide buffer solution, an ammonium chloride/ammonia buffer solution, a n,N-diethylglycine sodium salt/hydrochloric acid buffer solution, a tris(hydroxymethyl) aminomethane/hydrochloric acid buffer solution, a 2-amino-2-methyl-1,3-propanediol/hydrochloric acid buffer solution, a boric acic/sodium hydroxide buffer solution, a sodium hydrogen carbonate/sodium hydroxide buffer solution, a sodium hydroxide/potassium chloride buffer solution and the like.

However, none of the above-mentioned buffer solutions is necessary, if an image receiving medium is employed which can substantially maintain an initial value of pH.

Also in the case that an image is transferred to an image receiving medium due to ion exchange alone, it is preferred to use an image receiving medium which can maintain a pH value of at least the surface thereof, which is brought into contact with an electroconductive polymer layer, and a vicinity of the surface substantially constant, because the process of the ion exchange can be maintained substantially at a constant rate.

As explained in the above, a dye is transferred from an image forming medium to an image receiving medium.

As for the method for the intake and holding (doping) of a dye in the step (1), there is no restriction and a variety of methods are available, which are explained in detail below.

Examples of the methods are (i) a method in which a dye is taken in at the time of the preparation of the image forming medium; (ii) a method using an electrode pattern as illustrated in FIG. 16; (iii) a method in which the potential of an image forming medium is controlled in an electrolyte solution to electrochemically oxidize or reduce the electroconductive polymer layer, so that an ionic dye is doped in advance in conformity with a predetermined image pattern; and (iv) a method in which an image forming medium utilizes a substrate or film of an inorganic or organic semiconductor as an electroconductive substrate on which an electroconductive polymer layer is provided and the image forming medium is irradiated with light to generate a photoelectromotive force, so that a region-selective doping can be effected in the irradiated part.

The methods (iii) and (iv) are explained more specifically.

In one example of the method (iii), a needle-like electrode may be employed for the purpose of concentrating the electric field, thus preventing the spread of the electric field. In this case, it is necessary to raise the resistivity of the electrolyte solution in order to prevent the spread of the electric lines of force.

In the method (iv), any semiconductor which generates an electric force when irradiated with light (photo-semiconductor). Examples of the semiconductors are an inorganic conductor and an organic semiconductor. Typical examples of an inorganic semiconductor are Si, Ge, GaAs, CdSe, CdS, CdTe, InP, AlSb, GaP and the like. Examples of an organic semiconductor are phthalocyanine, perylene, PVK and many other substances. Both n- and p-type semiconductors can be used.

In order to dope an electroconductive polymer layer formed on such a semiconductor substrate or film with a dye, a photoelectromotive force is generated by irradiation with light. The generated photoelectromotive force is preferably at a level sufficient for the doping of the ionic dye molecule. If the electoromotive force is insufficient, a potential which is slightly less than the threshold value for the doping is externally added so that a total applied voltage exceeds the threshold value by the irradiation with light.

However, since a n-type semiconductor and a p-type semiconductor exhibit electric characteristics in an opposite manner, the doping or dedoping methods differ accordingly. For example, in the case that a n-type semiconductor is used, irradiation with light in addition to the application of a bias voltage causes the doping of an anionic dye molecule and the dedoping of a cationic dye molecule. On the other hand, in the case that a p-type semiconductor is used, irradiation with light in addition to the application of a bias voltage causes the doping of a cationic dye molecule and the dedoping of an anionic dye molecule.

In the case that an image forming medium is immersed in an electrolyte solution containing an ionic dye molecule, the doping amount of the ionic dye molecule can be controlled by the concentration of the dye molecule ion, the potentials of the electroconductive substrate (i.e., an electrode) and of the electroconductive polymer layer, the amount of the irradiated light, the applied voltage and the time period of irradiation, and the doping amount is basically proportional to the charge amount flowing during the doping. Therefore, an electroconductive polymer layer containing a high concentration of the dye molecule ion can be obtained from an oxidation or reduction of the electroconductive polymer layer in an electrolyte solution containing the dye molecule ion by regulating the potential of the electroconductive substrate (i.e., an electrode).

In the case that a n-type photo-semiconductor is utilized as an electroconductive substrate (electrode), the oxidized state of an electroconductive polymer layer is changed by use of the photoelectromotive force of the n-type photo-semiconductor, so that only the irradiated region of the electroconductive polymer layer creates an image pattern in the form of a distribution of concentration of the doping amount of the anionic dye molecule in response to the intensity of light. The application of a voltage in the direction which is opposite to that of the voltage at the time of the doping operation causes the electroconductive polymer layer to release the anionic dye molecule taken in previously. In the case that a p-type photo-semiconductor is utilized as an electroconductive substrate, the oxidized state of an electroconductive polymer layer is changed by use of the photoelectromotive force of the p-type photo-semiconductor, so that only the irradiated region of the electroconductive polymer layer creates an image pattern in the form of a distribution of concentration of the doping amount of the cationic dye molecule in response to the intensity of light. The application of a voltage in the direction which is opposite to that of the voltage at the time of the doping operation causes the electroconductive polymer layer to release the cationic dye molecule taken in previously.

Figure 20:
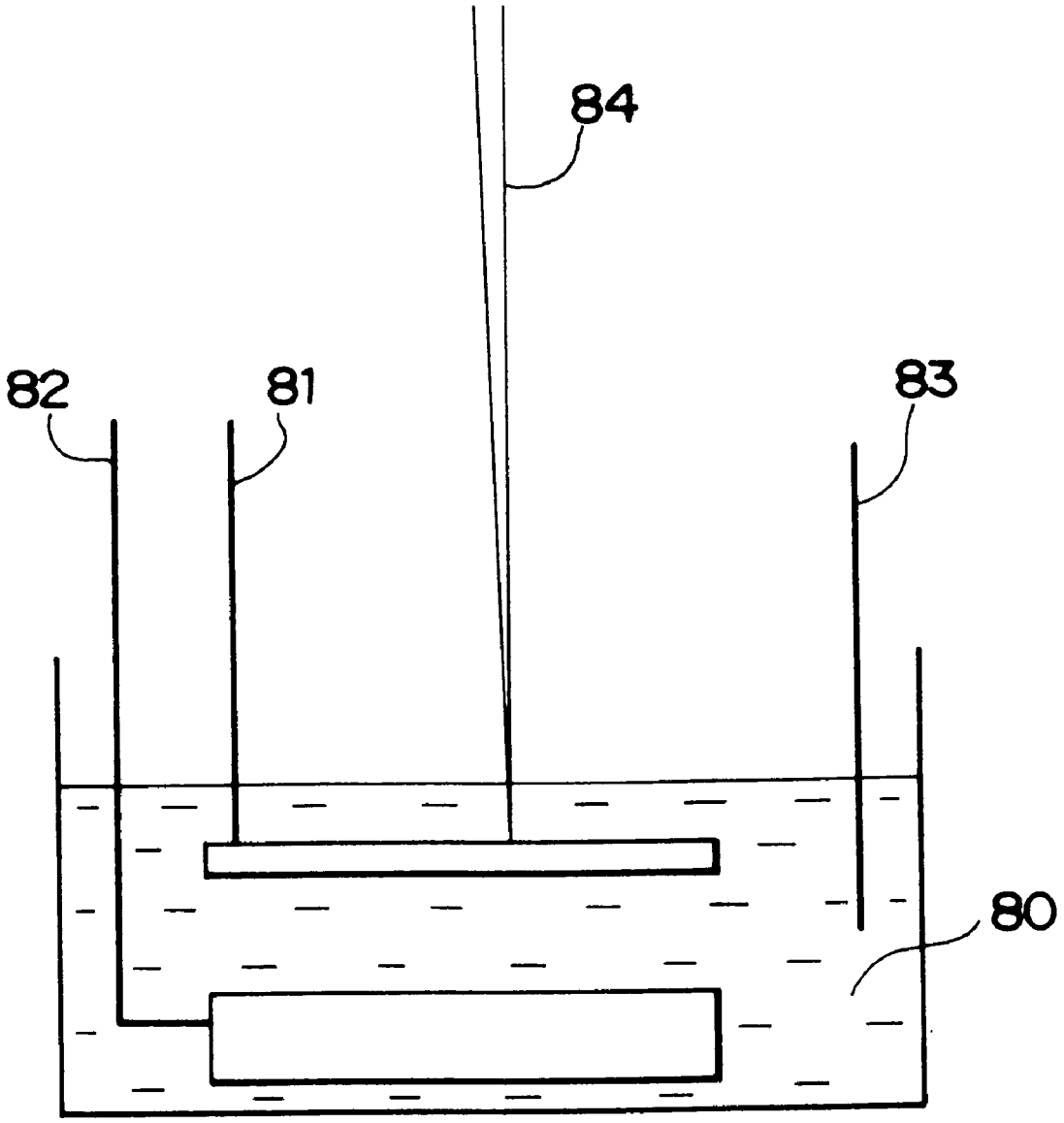
FIG. 20 is a schematically diagram illustrating a process of forming an image pattern on an image forming medium utilizing a photo-semiconductor.

The above process is explained in accordance with FIG. 20. A n-Si or p-Si working electrode 81, a counter platinum electrode 82 and a saturated calomel electrode 83 as a reference electrode are immersed in a vessel containing an aqueous pyrrole solution of a rose bengal dye 80. While applying an electric current to the working electrode 81 and the counter platinum electrode 82, the working electrode 81 is irradiated patternwise with a laser light 84 from a radiation unit such as a galvanoscanner. As a result, a polypyrrole thin film containing a rose bengal dye is formed on only the irradiated region of the working electrode 81. In this way, an image forming medium having an image pattern is prepared.

If the above-described procedure is employed in the aforementioned step (1), the action of the photoelectromotive force can be used jointly with the action of an ion exchange or with a combination of the action of an ion exchange and the application of an electric current for the dedoping to effect the image transfer in the step (3). In the electroconductive polymer layer where an anionic or cationic dye molecule is taken electrochemically, a dedoping action in accordance with the quantity of light can be effected if the ion exchange is carried out uniformly. That is, an electroconductive polymer layer, which takes in a cationic dye molecule, formed on a n-type photo-semiconductor is prepared, and the oxidized state of the electroconductive polymer layer is changed by use of the photoelectromotive force of the n-type photo-semiconductor, so that a distribution of concentration of the dedoping amount of the cationic dye molecule in response to the intensity of light only in the irradiated region of the electroconductive polymer layer is produced as a transfer pattern. Alternatively, an electroconductive polymer layer, which takes in an anionic dye molecule, formed on a p-type photo-semiconductor is prepared, and the oxidized state of an electroconductive polymer layer is changed by use of the photoelectromotive force of the p-type photo-semiconductor, so that a distribution of concentration of the dedoping amount of the anionic dye molecule in response to the intensity of light only in the irradiated region of the electroconductive polymer layer is produced as a transfer pattern.

The present invention is further explained by way of following examples.

EXAMPLE 1

Figure 21:
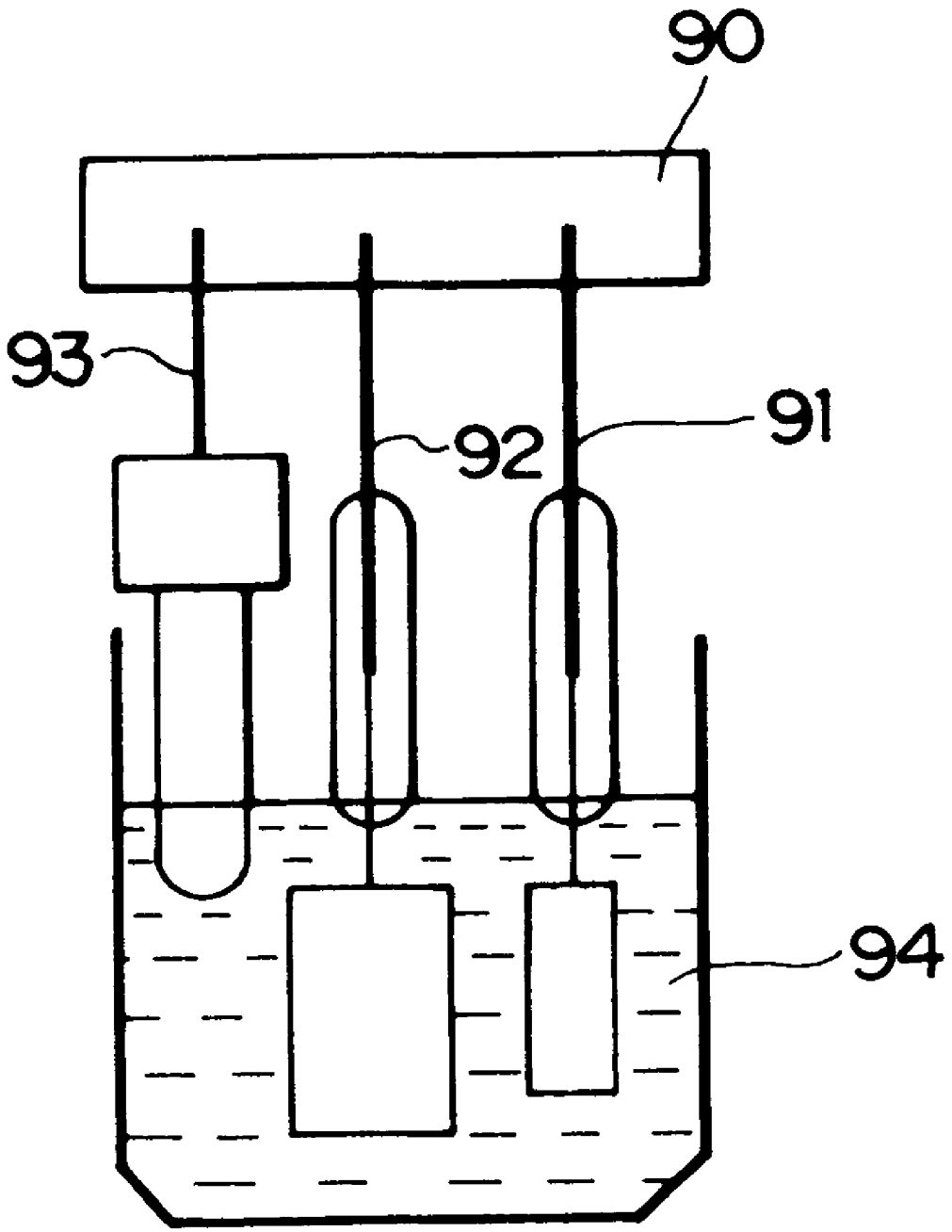
FIG. 21 is a schematically diagram illustrating a device for manufacturing an image forming medium used in Example 1 of the present invention.

As illustrated in FIG. 21, an apparatus having three electrodes which was generally employed in electrochemistry was prepared. The apparatus comprised a working electrode (platinum plate electrode) 91, a counter electrode (platinum plate electrode) 92 and a reference electrode (saturated calomel electrode) 93 which were linked to a potentiostat 90 and were immersed in an aqueous solution 94 containing 0.06M of pyrrole and 0.02M of rose bengal.

Application of a voltage to hold the platinum plate electrode 91 at +0.8 V for 30 seconds versus the saturated calomel electrode 93, in an aqueous solution 94 containing 0.06M of pyrrole and 0.02M of rose bengal, produced a polypyrrole thin film on the platinum electrode 91 as a result of an electrolytic oxidation polymerization of the pyrrole. The image forming medium thus obtained was washed with pure water and was brought into contact with a paper (image receiving medium) impregnated with an alkaline buffer solution having a pH value of 10 as illustrated in FIG. 7. Rose bengal dye was transferred on the paper by the ion exchange between $OH^-$ in the alkaline buffer solution and the rose bengal anion in the thin film and without the application of an electric current.

EXAMPLE 2

Figure 19:
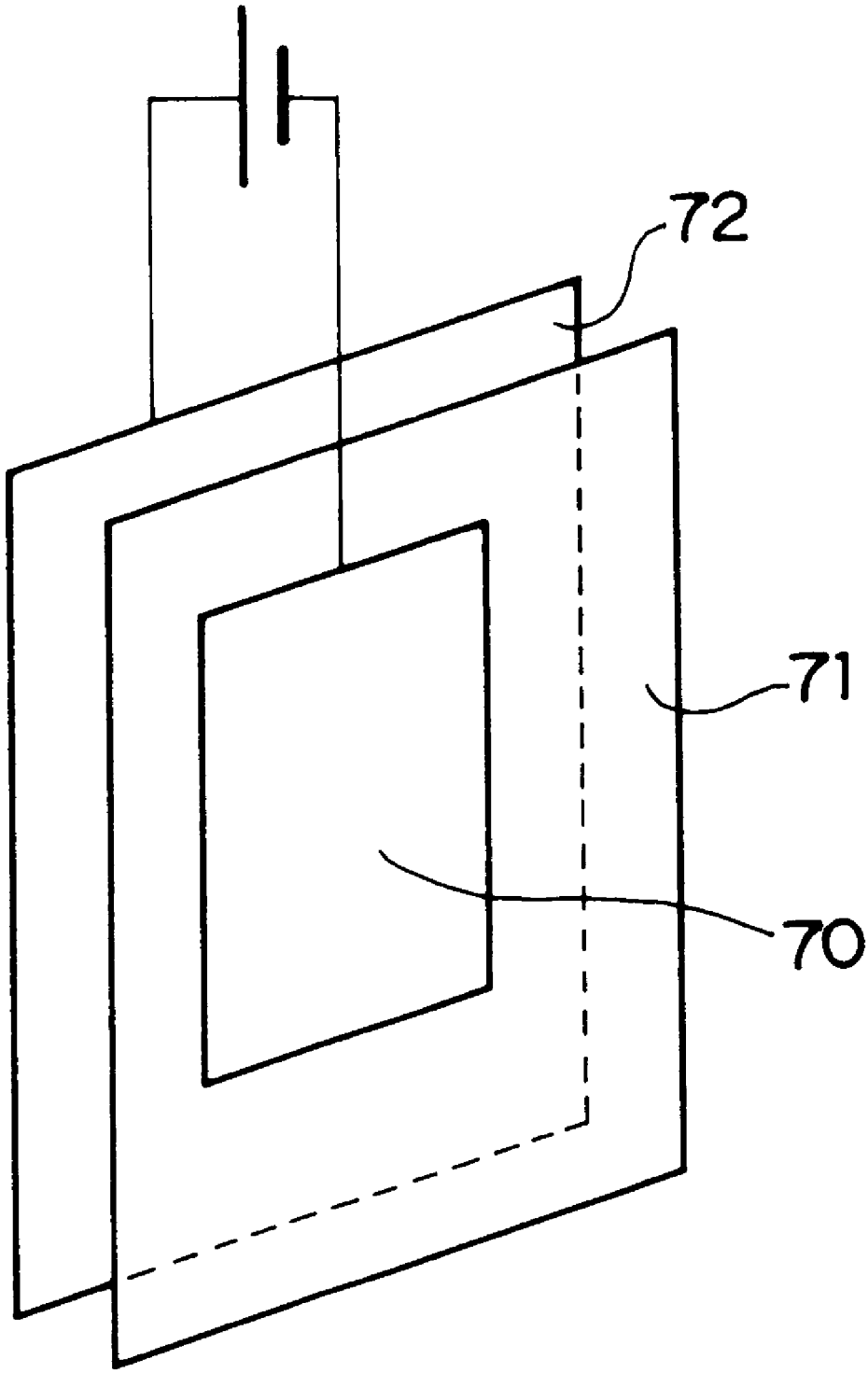
FIG. 19 is a schematically diagram illustrating one embodiment in which image transfer is performed by the application of an electric current and by an ion exchange.

As in Example 1, the application of a voltage to hold the platinum plate electrode 91 at +0.8 V for 30 seconds versus the saturated calomel electrode 93, in an aqueous solution 94 containing 0.06M of pyrrole and 0.02M of rose bengal, produced a polypyrrole thin film on the platinum electrode 91 as a result of an electrolytic polymerization of the pyrrole. The image forming medium thus obtained was washed with pure water and was brought into contact with a paper impregnated with an alkaline buffer solution having a pH value of 10, a counter platinum electrode was placed on the back side of the paper as illustrated in FIG. 19, and the platinum electrode was given a potential of −1.0 V. Since this treatment increased the dedoping speed of the rose bengal anion, the speed of the transfer of the rose bengal dye to the paper increased.

EXAMPLE 3

A n-Si substrate was subjected to an ultrasonic cleaning in a mixture of acetone and isopropyl alcohol. After washing with water, the substrate was immersed in a buffered hydrofluoric acid to remove an oxide film. Al was deposited on the substrate by a vacuum deposition method using resistance heating to obtain an ohmic contact. This n-Si substrate was used as a working electrode 81 together with a counter platinum electrode 82 as illustrated in FIG. 20. Then a voltage was applied to hold the working electrode of the n-Si substrate 81 at +0.4 V versus the saturated calomel electrode 83, in an aqueous solution 80 containing 0.06M of pyrrole and 0.02M of rose bengal, and the working electrode of the n-Si substrate 81 was irradiated with a laser light 84 from an external galvanoscanning unit in the form of an image pattern, as illustrated in FIG. 20. This procedure produced a polypyrrole thin film containing rose bengal only in the irradiated region of the n-Si substrate, thereby forming an image. The image forming medium having the image (n-Si substrate partially covered with a thin film) thus obtained was washed with pure water and was then brought into contact with a paper (image receiving medium) impregnated with an alkaline buffer solution having a pH value of 10. The image of the rose bengal dye was transferred on the paper without the application of an electric current. Besides, the obtained image forming medium having the image was washed with pure water and was brought into contact with a paper impregnated with an alkaline buffer solution having a pH value of 10, a counter platinum electrode was placed on the back side of the paper and the platinum electrode was given a potential to that of the n-Si substrate of −1.0 V as illustrated in FIG. 19. By this treatment, the speed of the transfer of the rose bengal dye to the paper was increased.

EXAMPLE 4

A p-Si substrate was subjected to an ultrasonic cleaning in a mixture of acetone and isopropyl alcohol. After washing with water, the substrate was immersed in a buffered hydrofluoric acid to remove an oxide film. Al was deposited on the substrate by a vacuum deposition method using resistance heating to obtain an ohmic contact.

As in Example 1, the application of a voltage to hold the p-Si as a working electrode 81 at +0.8 V for 30 seconds versus the saturated calomel electrode 83, in an aqueous solution 94 containing 0.06M of pyrrole and 0.02M of rose bengal, produced a polypyrrole thin film on the p-Si substrate containing rose bengal. The polypyrrole thin film of the image forming medium, which was doped with rose bengal, exhibited a uniform magenta color. The image forming medium thus obtained was washed with pure water. And, the image forming medium was used as a working electrode 81 together with a platinum electrode 82 as a counter electrode in FIG. 20. Then a voltage was applied to hold the working electrode of the p-Si substrate 81 at −0.4 V versus the saturated calomel electrode 83, in an aqueous solution 80 containing 0.06M of pyrrole and 0.02M of rose bengal, and the working electrode of the n-Si substrate 81 was irradiated with a laser light 84 from an external galvanoscanning unit in the form of an image pattern. This procedure produced a negative image, because the rose bengal was dedoped from the polypyrrole thin film only in the irradiated region on the p-Si substrate. The image forming medium with the image (p-Si substrate partially covered with a thin film) thus obtained was washed with pure water and was brought into contact with a paper impregnated with an alkaline buffer solution having a pH value of 10. The rose bengal dye adhered to the paper and, therefore, a negative image was transferred.

Normally, it is difficult to pass a negative current through a p-Si substrate and, therefore, it is necessary to irradiate the substrate with light or to apply an excessively large voltage. However, the contact the image forming medium of the present invention with a paper impregnated with an alkaline buffer solution made it possible to transfer an image without the application of any voltage.

Comparative Example 1

Application of a voltage to hold a platinum plate electrode at +0.8 V for 30 seconds versus the saturated calomel electrode, in an aqueous solution containing 0.06M of pyrrole and 0.02M of rose bengal, produced a polypyrrole thin film on the platinum electrode as a result of an electrolytic polymerization of the pyrrole. This polypyrrole thin film exhibited a magenta color, because the polypyrrole was doped with the rose bengal. The image forming medium thus obtained was washed with pure water and was brought into a contact with a paper impregnated with a 0.1M sodium chloride aqueous solution, a counter platinum electrode was placed on the back side of the paper, and the platinum electrode, which was coated with the polypyrrole film containing rose bengal, was given a potential of −1.0 V for 30 seconds. This treatment caused the depoping of the rose bengal anion, which adhered to the paper. However, after a few days, the color of the transferred pattern became pale due to the fading of the rose bengal.

Comparative Example 2

Figure 22:
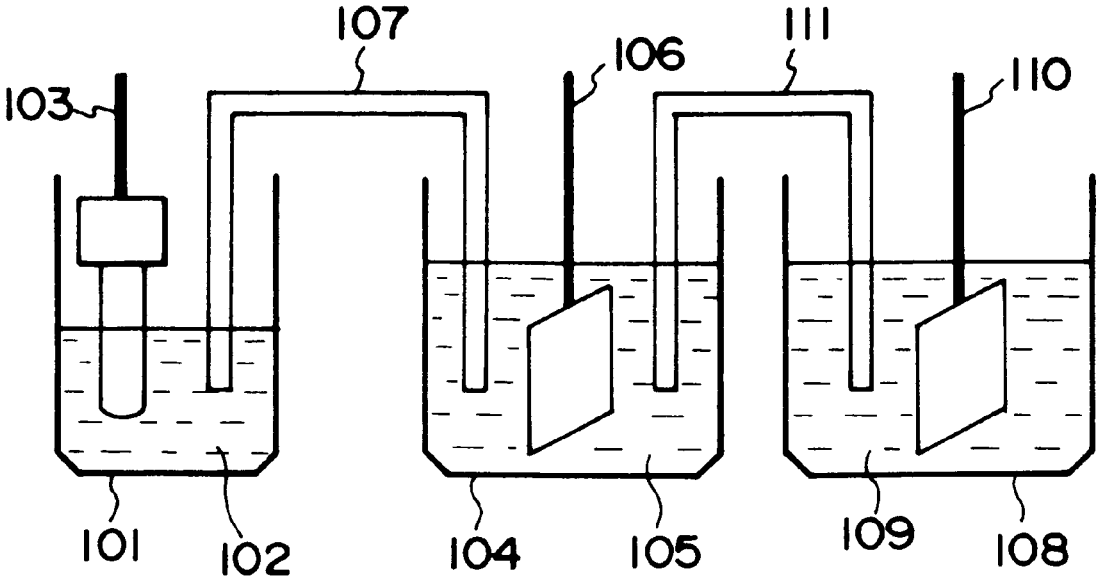
FIG. 22 is a schematically diagram illustrating a device for manufacturing an image forming medium used in Example 5 of the present invention.

As illustrated in FIG. 22, a reference electrode 103, which was immersed in a naCl aqueous solution 102 in a vessel 101, was linked to a counter 106, which was immersed in a naCl aqueous solution 105 in a vessel 104, by means of a salt bridge 107. Further, the counter electrode 106 was linked to a working electrode 110, which was immersed in a naCl aqueous solution 109 in a vessel 108, by means of a salt bridge 111. In this manner, the electrodes were separated from one another in the above-described apparatus. In this apparatus, a polypyrrole-coated platinum substrate, which had been prepared in the same way as in Referential Example 1 and polypyrrole film on which contained rose bengal, was utilized as the working electrode 110. When the working electrode 110 was given a potential of −1.0 V for 10 minutes versus the saturated calomel electrode 103. At first, the aqueous solution was red due to the rose bengal dedoped from the polypyrrole, but the solution became colorless after a while. Although the pH value of the NaCl aqueous solution was 5.79 at first, after 10 minutes the pH value of the solution in which the counter electrode 106 was immersed was 5.98 and the pH value of the solution in which the working electrode 110 was immersed was 4.11. From this fact, it was found that the application of the electric current produced a condition of pH=4.5 or below where the rose bengal fades or precipitates.

EXAMPLE 5

As in Referential Example 2, application of a voltage to hold a platinum working electrode at +0.8 V for 30 seconds versus the saturated calomel electrode, in an aqueous solution containing 0.06M of pyrrole and 0.02M of rose bengal, produced a polypyrrole thin film on the platinum electrode as a result of an electrolytic polymerization of the pyrrole. The polypyrrole-coated platinum electrode thus obtained was washed with pure water and was brought into a contact with a paper impregnated with a phosphoric acid standard solution having a pH value of 7.0, a counter platinum electrode was placed on the back side of the paper as illustrated in FIG. 19, and the polypyrrole-coated platinum electrode was given a potential of −1.0 V for 30 seconds. This treatment caused the depoping of the rose bengal, which adhered to the paper. However, the color of the transferred pattern did not become pale even after the lapse of time. As evidenced by this fact, the use of a neutral buffer solution made it possible to keep the dye in a stabilized state.

The image forming method of the present invention can save resources, because the image is formed by the release and transfer of ionic dye molecule held in an electroconductive polymer layer, to an image receiving medium and the ionic dye molecule alone is consumed. Most of the ionic dye molecules are so safe that they are used as a food additive and generate basically no harmful substance. High resolution of the image which is the level of one dye ion is possible theoretically. And, the image is excellent in gradation owing to an exact distribution of potential.

In addition, according to the image forming process of the present invention, the transfer process is very simple and economical, because application of an electric current is not necessary. Further, the image forming method is applicable to general purposes, because even in the case of using an image forming medium which allows the flow of electric current only in one direction and which is represented by a p-type semiconductor or a n-type semiconductor, a dye molecule can be held in the image forming medium or can be released from the image forming medium.

What is claimed is:

1. An image forming method utilizing an electroconductive polymer, said method comprising the steps of:

(1) preparing an image forming medium which comprises an electroconductive substrate and an electroconductive polymer layer thereon capable of taking in and holding ionic dyes as a result of the change in at least two states selected from the group consisting of an oxidized state, a neutral state and a reduced state of the electroconductive polymer and which holds the ionic dye, (2) bringing an image receiving medium, which has ions of the same polarity as that of the ionic dye held in the electroconductive polymer layer, into contact with the electroconductive polymer layer, and (3) forming an image pattern of the ionic dye on the image receiving medium by conducting ion exchanges between the ionic dye held in the electroconductive polymer layer and the ion in the image receiving medium.

2. The image forming method of claim 1 wherein an electric current is applied between the electroconductive substrate and the image receiving medium in the step (3).

3. The image forming method of claim 1 wherein a pH value of at least the surface of the image receiving medium, which surface is in contact with the electroconductive polymer layer, and a vicinity of the surface is maintained substantially constant.

4. The image forming method of claim 2 wherein a pH value of at least the surface of the image receiving medium, which surface is in contact with the electroconductive polymer layer, and a vicinity of the surface is maintained substantially constant.

5. The image forming method of claim 3 wherein the image receiving medium contains a buffer solution which lessens the change in pH value of at least the surface of the image receiving medium which surface is in contact with the electroconductive polymer layer, and a vicinity of the surface.

6. The image forming method of claim 4 wherein the image receiving medium contains a buffer solution which lessens the change in pH value of at least the surface of the image receiving medium which surface is in contact with the electroconductive polymer layer, and a vicinity of the surface.

7. The image forming method of claim 1 wherein the image receiving medium is a medium containing an electrolyte solution.

8. The image forming method of claim 7 wherein the electrolyte solution is an alkaline solution and the ionic dye molecule held in the electroconductive polymer layer is an anion capable of ion-exchanging with the $OH^-$ ion.

9. The image forming method of claim 7 wherein the electrolyte solution is an acidic solution and the ionic dye molecule held in the electroconductive polymer layer is a cation capable of ion-exchanging with the $H^+$ ion.

10. The image forming method of claim 1 wherein the ionic dye molecule is selectively held in the image forming medium in the step (1) by bringing the image forming medium into contact with the electrolyte solution and controlling the potential of the electroconductive substrate of the image forming medium.

11. The image forming method of claim 10 wherein the electroconductive substrate comprises an organic or inorganic semiconductor substrate or film and the electroconductive polymer layer is formed thereon.

12. The image forming method of claim 11 wherein the ionic dye molecule is selectively held in the image forming medium in the step (1) by generating an electromotive force partially in the organic or inorganic semiconductor substrate or film.

13. An image forming medium for use in the method of claim 1 comprises on an electroconductive substrate an electroconductive polymer layer capable of taking in and holding an ionic dye as a result of the change in at least two states selected from the group consisting of an oxidized state, a neutral state and a reduced state of the electroconductive polymer.

14. An image receiving medium for use in the method of claim 1 which is capable of containing an ion dissolved in an electrolyte solution.

* * * * *